US011267240B2

(12) United States Patent
Doi et al.

(10) Patent No.: US 11,267,240 B2
(45) Date of Patent: Mar. 8, 2022

(54) INKJET PRINTING APPARATUS, PRINTING METHOD, AND STORAGE MEDIUM

(71) Applicant: CANON KABUSHIKI KAISHA, Tokyo (JP)

(72) Inventors: Tsukasa Doi, Tokyo (JP); Hiromitsu Yamaguchi, Yokohama (JP); Akitoshi Yamada, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 94 days.

(21) Appl. No.: 16/842,823

(22) Filed: Apr. 8, 2020

(65) Prior Publication Data

US 2020/0324544 A1 Oct. 15, 2020

(30) Foreign Application Priority Data

Apr. 15, 2019 (JP) ..... JP2019-077273

(51) Int. Cl.
*B41J 2/205* (2006.01)
*B41J 2/045* (2006.01)
*B41J 2/21* (2006.01)

(52) U.S. Cl.
CPC ..... *B41J 2/04501* (2013.01); *B41J 2/2052* (2013.01); *B41J 2/2103* (2013.01); *B41J 2/2107* (2013.01); *B41J 2/21* (2013.01); *B41J 2202/04* (2013.01)

(58) Field of Classification Search
CPC .... B41J 2/04501; B41J 2/2103; B41J 2/2107; B41J 2202/04; B41J 2/2052; B41J 2/21
See application file for complete search history.

(56) References Cited

U.S. PATENT DOCUMENTS

| | | | |
|---|---|---|---|
| 5,847,719 | A | 12/1998 | Yamaguchi et al. |
| 5,847,723 | A | 12/1998 | Akahira et al. |
| 5,864,349 | A | 1/1999 | Hirabayashi et al. |
| 5,877,783 | A | 3/1999 | Iwasaki et al. |
| 5,971,525 | A | 10/1999 | Inoue et al. |
| 5,980,012 | A | 11/1999 | Fujita et al. |
| 6,000,781 | A | 12/1999 | Akiyama et al. |
| 6,312,095 | B1 | 11/2001 | Hiramatsu et al. |
| 6,325,479 | B1 | 12/2001 | Nakamura et al. |

(Continued)

FOREIGN PATENT DOCUMENTS

JP 2016-055463 A 4/2016

OTHER PUBLICATIONS

U.S. Appl. No. 16/868,259, filed Apr. 2, 2020.
U.S. Appl. No. 16/842,824, filed Apr. 8, 2020.

*Primary Examiner* — Yaovi M Ameh
(74) *Attorney, Agent, or Firm* — Venable LLP

(57) ABSTRACT

Provided is an inkjet printing apparatus including: a print head configured to eject a metallic ink containing silver particles; a carriage configured to scan the print head; and a control unit configured to control the print operation so as to print an image on a print medium by causing the print head to eject the metallic ink onto the print medium and thereby form dots on the print medium while causing the carriage to scan the print head a plurality of times over a predetermined region on the print medium, wherein the control unit controls the print operation so as to print the image by causing the print head to eject the metallic ink at the same pixel position on the print medium in two or more printing scans and thereby generate a superimposed dot.

22 Claims, 24 Drawing Sheets

(56) References Cited

U.S. PATENT DOCUMENTS

| | | | |
|---|---|---|---|
| 6,540,346 | B1 | 4/2003 | Akahira et al. |
| 6,612,678 | B2 | 9/2003 | Kato et al. |
| 6,860,578 | B2 | 3/2005 | Yamada et al. |
| 6,877,835 | B2 | 4/2005 | Kato et al. |
| 7,125,095 | B2 | 10/2006 | Yamada et al. |
| 7,237,871 | B2 | 7/2007 | Yamaguchi et al. |
| 7,278,700 | B2 | 10/2007 | Yamaguchi et al. |
| 7,296,868 | B2 | 11/2007 | Shibata et al. |
| 7,360,856 | B2 | 4/2008 | Ochiai et al. |
| 7,431,426 | B2 | 10/2008 | Yamaguchi et al. |
| 7,585,040 | B2 | 9/2009 | Ochiai et al. |
| 7,726,767 | B2 | 6/2010 | Noguchi et al. |
| 7,773,244 | B2 | 8/2010 | Yano et al. |
| 7,837,283 | B2 | 11/2010 | Goto et al. |
| 7,880,910 | B2 | 2/2011 | Aichi et al. |
| 7,959,259 | B2 | 6/2011 | Yamaguchi et al. |
| 7,961,345 | B2 | 6/2011 | Yano et al. |
| 8,018,621 | B2 | 9/2011 | Marumoto et al. |
| 8,174,711 | B2 | 5/2012 | Yano et al. |
| 8,184,339 | B2 | 5/2012 | Marumoto et al. |
| 8,203,741 | B2 | 6/2012 | Yano et al. |
| 8,210,638 | B2 | 7/2012 | Wada et al. |
| 8,287,074 | B2 | 10/2012 | Kano et al. |
| 8,395,802 | B2 | 3/2013 | Yano et al. |
| 8,430,472 | B2 | 4/2013 | Nishikori et al. |
| 8,711,453 | B2 | 4/2014 | Yamada et al. |
| 8,743,420 | B2 | 6/2014 | Ishikawa et al. |
| 8,896,883 | B2 | 11/2014 | Goto et al. |
| 8,896,884 | B2 | 11/2014 | Yamada et al. |
| 8,911,048 | B2 | 12/2014 | Yamada et al. |
| 8,936,341 | B2 | 1/2015 | Kagawa et al. |
| 8,960,834 | B2 | 2/2015 | Goto et al. |
| 9,007,655 | B2 | 4/2015 | Iguchi et al. |
| 9,030,712 | B2 | 5/2015 | Saito et al. |
| 9,044,947 | B2 | 6/2015 | Wada et al. |
| 9,073,341 | B2 | 7/2015 | Yamada et al. |
| 9,195,917 | B2 | 11/2015 | Nakagawa et al. |
| 9,389,824 | B2 | 7/2016 | Yano et al. |
| 10,071,569 | B2 | 9/2018 | Ochi et al. |
| 2003/0222985 | A1 | 12/2003 | Goto et al. |
| 2011/0019208 | A1 | 1/2011 | Yamaguchi et al. |
| 2012/0223998 | A1* | 9/2012 | Kagata ..... G06K 15/1869 347/20 |
| 2012/0313990 | A1* | 12/2012 | Sakai ..... B41J 19/142 347/12 |
| 2017/0282540 | A1 | 10/2017 | Ochi et al. |

* cited by examiner

LANDED

PERMEATED

FUSED

INKJET PRINTING APPARATUS, PRINTING METHOD, AND STORAGE MEDIUM

BACKGROUND OF THE INVENTION

Field of the Invention

The present invention relates to an inkjet printing apparatus, a printing method, and a storage medium.

Description of the Related Art

In recent years, metallic inks have been developed which contain metallic particles and are printable on a print medium by an inkjet printing apparatus or the like. Using a metallic ink can impart metallic gloss to a printed product. Japanese Patent Laid-Open No. 2016-55463 discloses a printing apparatus using a metallic ink containing silver particles.

In a liquid state, a metallic ink containing silver particles appears brownish due to localized surface plasmon resonance. In a case where a print medium is printed by an inkjet method using such an ink, the outer peripheries of metallic dots have a low density of silver particles and the fusion of the silver is therefore insufficient. This leaves the above-mentioned brownishness. Consequently, whole regions printed with the metallic ink containing silver particles may appear colored brownish.

SUMMARY OF THE INVENTION

An inkjet printing apparatus according to an aspect of the present invention comprises: a print head configured to eject a metallic ink containing silver particles; a carriage configured to scan the print head; and a control unit configured to control a print operation so as to print an image on a print medium by causing the print head to eject the metallic ink onto the print medium and thereby form dots on the print medium while causing the carriage to scan the print head a plurality of times over a predetermined region on the print medium, wherein the control unit controls the print operation so as to print the image by causing the print head to eject the metallic ink at the same pixel position on the print medium in two or more printing scans and thereby generate a superimposed dot.

Further features of the present invention will become apparent from the following description of exemplary embodiments with reference to the attached drawings.

DESCRIPTION OF THE EMBODIMENTS

Embodiments of the present invention will be described below with reference to the drawings. It should be noted that the following embodiments do not limit the present invention and that not all of the combinations of the features described in the present embodiments are necessarily essential for solving the problem to be solved by the present invention. Meanwhile, the description will be given with the same reference sign given to same components. Also, relative positions, shapes, and the like of the constituent elements described in the embodiments are exemplary only and are not intended to limit the scope of the invention only to those.

Printing System

Figure 1:
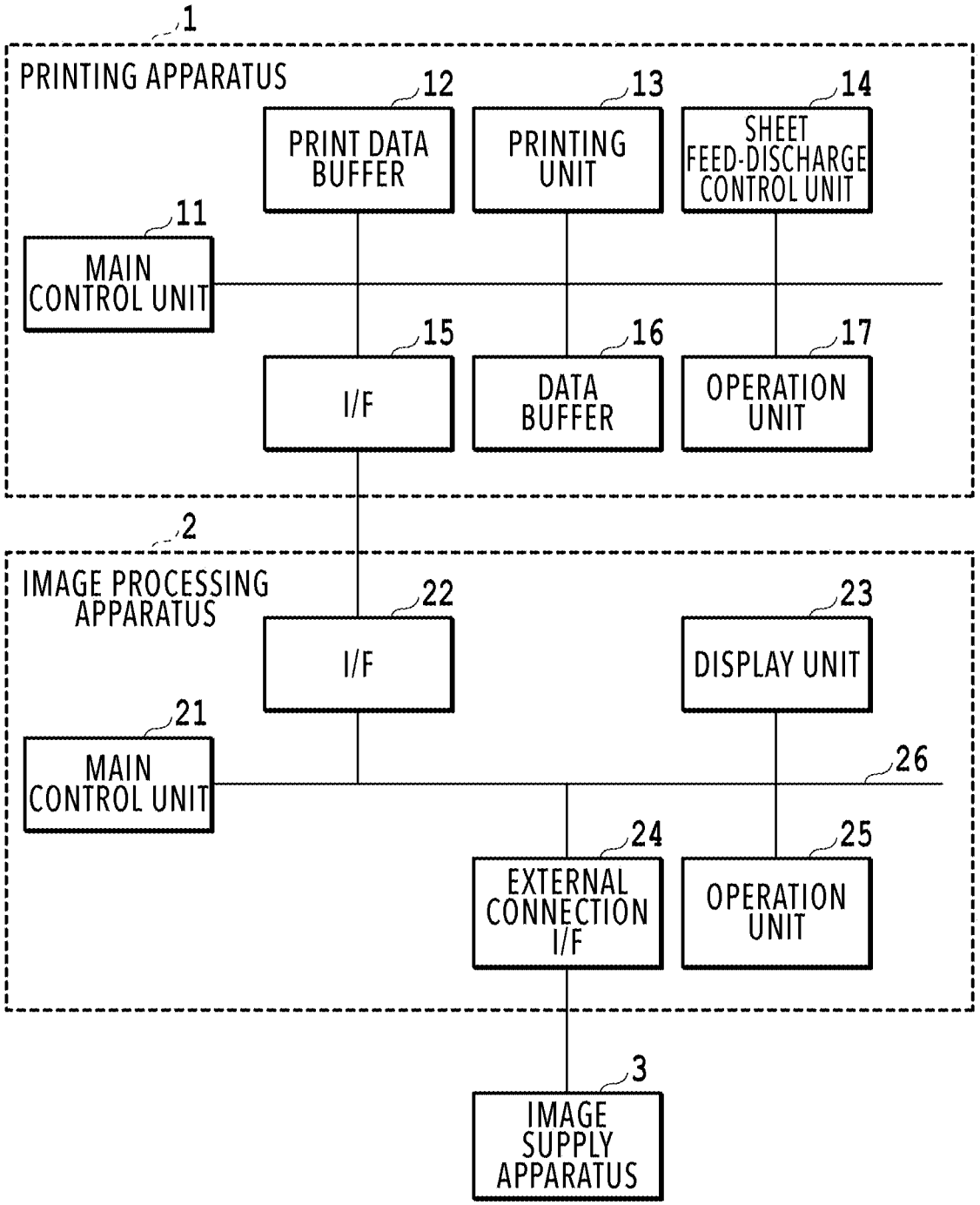
FIG. 1 is a block diagram showing a configuration of a printing system.

FIG. 1 is a diagram showing an example of a printing system in an embodiment. The printing system has an inkjet printing apparatus (hereinafter also referred to simply as the printing apparatus) 1, an image processing apparatus 2, and an image supply apparatus 3. The image supply apparatus 3 supplies image data to the image processing apparatus 2. The image processing apparatus 2 generates print data by performing predetermined image processing on the image data supplied from the image supply apparatus 3, and transmits the generated print data to the printing apparatus 1. The printing apparatus 1 prints an image on a print medium with inks based on the print data transmitted from the image processing apparatus 2.

A main control unit 11 of the printing apparatus 1 includes a CPU, a ROM, a RAM, and the like and takes overall control of the entire apparatus 1. In an example, the CPU of the main control unit 11 executes a later-described process shown in FIG. 8. A data buffer 16 temporarily stores image data received from the image processing apparatus 2 through an interface (I/F) 15. A print data buffer 12 temporarily stores print data to be transferred to a printing unit 13 in the form of raster data. An operation unit 17 is a mechanism with which the user performs command operations, and a touchscreen and operation buttons or the like can be used. A sheet feed-discharge control unit 14 controls the feed and discharge of print media.

The printing unit 13 includes an inkjet print head, and this print head has a plurality of nozzle arrays each formed of a plurality of nozzles capable of ejecting ink droplets. The printing unit 13 prints an image on a print medium by ejecting inks from printing nozzles based on the print data stored in the print data buffer 12. The present embodiment will be described by taking as an example a case where the print head has four printing nozzle arrays in total for inks of three chromatic colors of cyan (C), magenta (M), and yellow (Y) and a metallic (Me) ink.

Note that the printing apparatus 1 is also capable of directly receiving and printing image data stored in a storage medium such as a memory card and image data from a digital camera, as well as image data supplied from the image processing apparatus 2.

A main control unit 21 of the image processing apparatus 2 performs various processes on an image supplied from the image supply apparatus 3 to thereby generate image data printable by the printing apparatus 1, and includes a CPU, a ROM, a RAM, and the like. An I/F 22 passes and receives data signals to and from the printing apparatus 1. An external connection I/F 24 receives and transmits image data and the like from and to the externally connected image supply apparatus 3. A display unit 23 displays various pieces of information to the user, and an LCD or the like can be used, for example. An operation unit 25 is a mechanism with which the user performs command operations, and a keyboard and a mouse can be used, for example.

Printing Unit of Printing Apparatus

Figure 2:
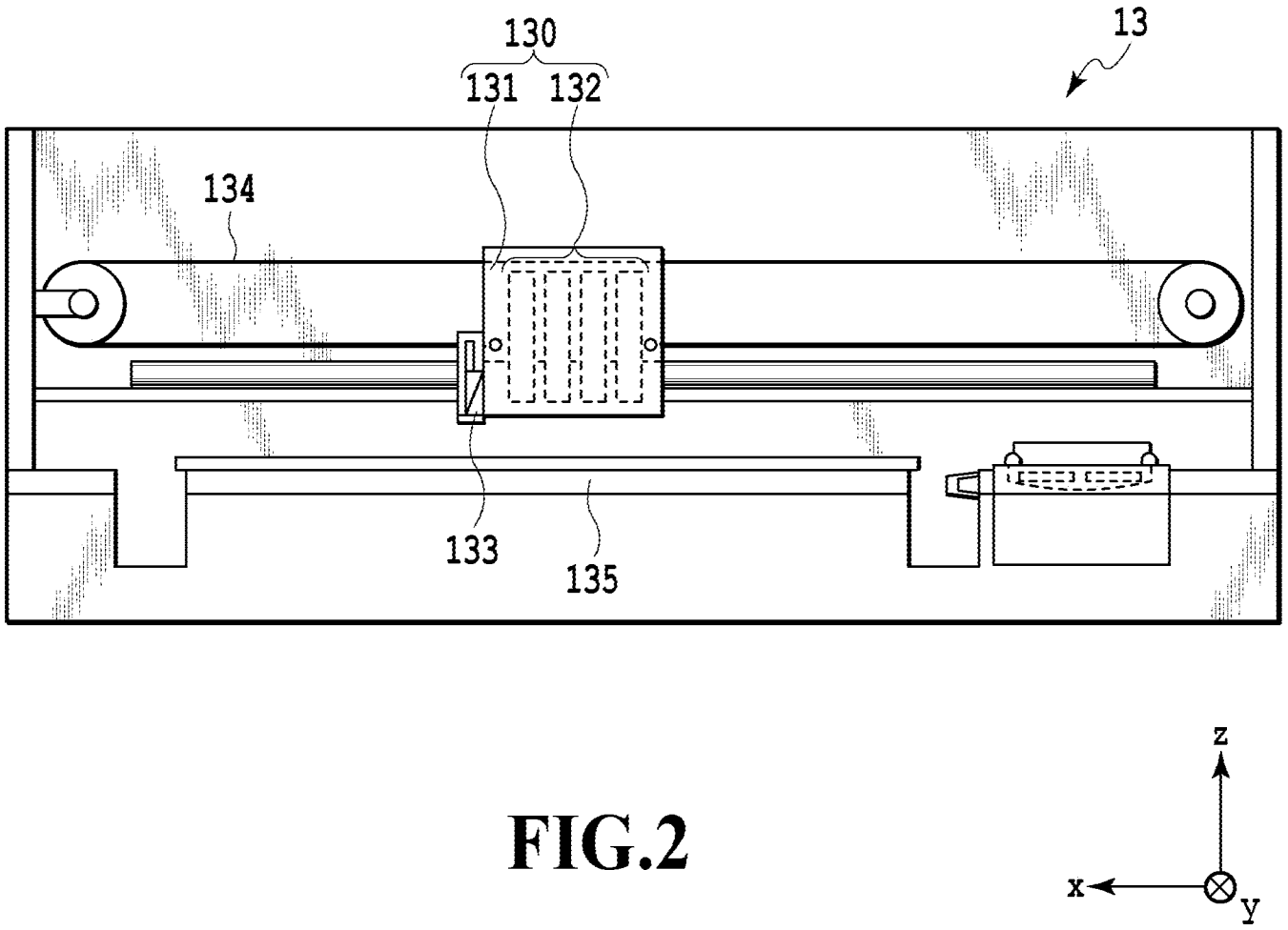
FIG. 2 is a diagram for explaining a configuration of a printing unit.

FIG. 2 is a diagram explaining a print head 130 included in the printing unit 13 in the present embodiment. The print head 130 has a carriage 131, nozzle arrays 132, and an optical sensor 133. The carriage 131, carrying the four nozzle arrays 132 and the optical sensor 133, is capable of reciprocally moving along the x direction in FIG. 2 (so-called main scanning direction) with driving force of a carriage motor transmitted to the carriage 131 through a belt 134. While the carriage 131 moves in the x direction relative to a print medium, the chromatic color inks in nozzles of the nozzle arrays 132 are ejected in the direction of gravity (−z direction in FIG. 2) based on print data. As a result, an image of a single main scan is printed on the print medium placed on a platen 135. After the completion of the single main scan, the print medium is conveyed along a conveyance direction (−y direction in FIG. 2) by a distance corresponding to the width of a single main scan. By alternately repeating a main scan and a conveyance operation as above, images are formed on the print medium in a step-by-step manner. The optical sensor 133 performs a detection operation while moving along with the carriage 131 to determine whether a print medium is present on the platen 135. The print head 130 is capable of printing an image on a predetermined region on a print medium while scanning over the region a plurality of times.

Description of Print Head

Figure 3:
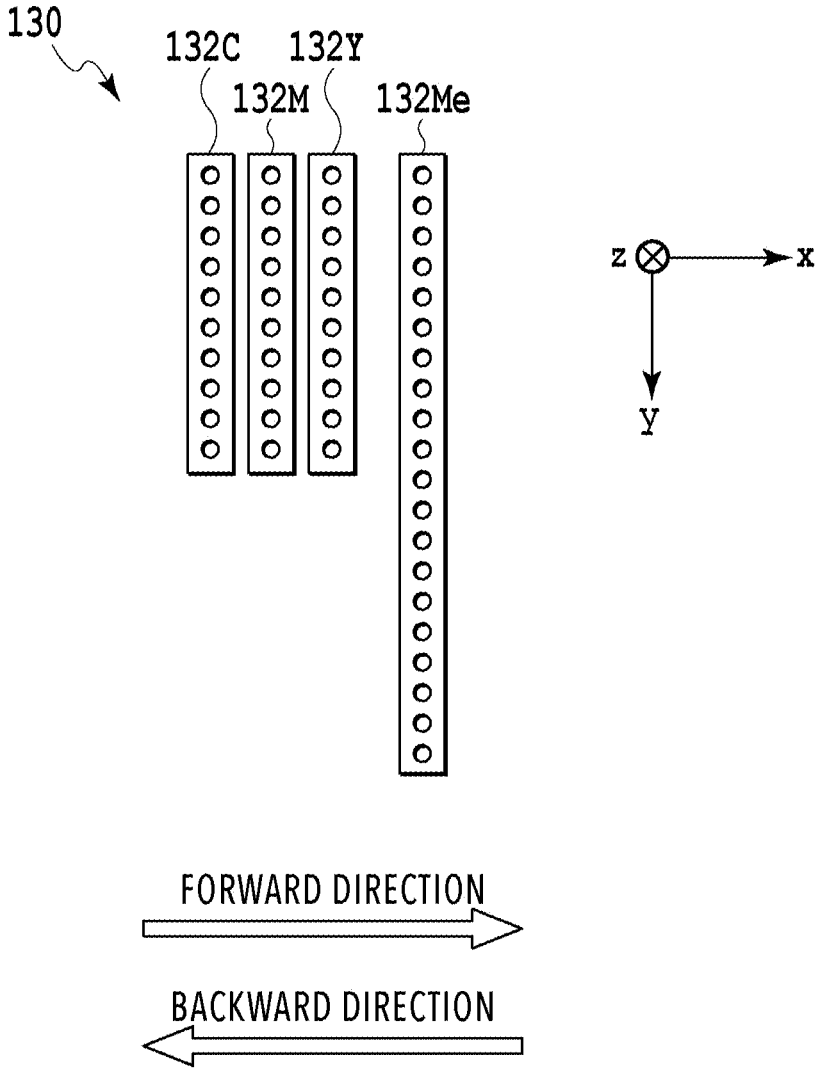
FIG. 3 is a diagram showing an arrangement of nozzle arrays.

FIG. 3 is a diagram showing an arrangement of the nozzle arrays of the print head 130 as viewed from the upper surface of the apparatus (z direction). Four nozzle arrays are disposed in the print head 130. Specifically, a nozzle array 132C for the C ink, a nozzle array 132M for the M ink, a nozzle array 132Y for the Y ink, and a nozzle array 132Me for the Me ink are disposed at different positions in the x direction. The C ink, the M ink, the Y ink, and the Me ink are ejected from the nozzles of the nozzle array 132C, the nozzles of the nozzle array 132M, the nozzles of the nozzle array 132Y, and the nozzles of the nozzle array 132Me, respectively. In each nozzle array, a plurality of nozzles for ejecting ink droplets are arrayed along the y direction at a predetermined pitch. Note that the number of nozzles included in each nozzle array is a mere example, and is not limited to the number shown.

Silver Nanoink

The metallic ink (Me ink) used in the present embodiment contains silver particles. The melting point of a metallic particle is dependent on the type of its substance and the size of the particle. The smaller the particle size, the lower the melting point. After the silver particles contained in the Me ink, having a small particle size of about several to several hundred nanometers, land on the printing surface of a print medium, their dispersed state breaks with reduction of water, and nearby silver particles fuse to one another, thereby forming a silver fused film. By forming the fused silver film on the print medium in this manner, a printed image having glossiness is formed.

Constituent components of the Me ink containing the silver particles used in the present embodiment will be described below.

Silver Particles

The silver particles used in the present embodiment are particles mainly containing silver, and the purity of silver in a silver particle may be 50% by mass or higher. In an example, the silver particles may contain another metal, oxygen, sulfur, carbon, and so on as sub components and may be made of an alloy.

The method of producing the silver particles is not particularly limited. However, considering particle size control and dispersion stability of the silver particles, the silver particles are preferably produced from a water-soluble silver salt by various synthetic methods utilizing reduction reactions.

The average particle size of the silver particles used in the present embodiment is preferably 1 nm or more and 200 nm or less and more preferably 10 nm or more and 100 nm or less in view of the storage stability of the ink and the glossiness of images to be formed with the silver particles.

Note that as for a specific method of measuring the average particle size, FPAR-1000 (manufactured by Otsuka Electronics Co., Ltd.; cumulant method analysis), Nanotrac UPA150EX (manufactured by NIKKISO CO., LTD., employing an accumulated value of 50% of the volume-average particle size), or the like utilizing scattering of a laser beam can be used for the measurement.

In the present embodiment, the content (% by mass) of the silver particles in the ink is preferably 2.0% by mass or more and 15.0% by mass or less based on the entire mass of the ink. In a case where the content is less than 2.0% by mass, the metallic glossiness of an image may be low. On the other hand, in a case where the content is more than 15.0% by mass, ink overflow is likely to occur, which may in turn cause print twists.

Dispersant

The method of dispersing the silver particles is not particularly limited. It is possible to use, for example, silver particles dispersed by a surfactant, resin-dispersed silver particles dispersed by a dispersing resin, or the like. It is of course possible to use a combination of metallic particles differing in dispersion method.

As the surfactant, an anionic surfactant, a nonionic surfactant, a cationic surfactant, or an amphoteric surfactant can be used. Specifically, the following can be used, for example.

Examples of the anionic surfactant include fatty acid salts, alkylsulfuric acid ester salts, alkylarylsulfonic acid salts, alkyldiarylether disulfonic acid salts, dialkylsulfosuccinic acid salts, alkylphosphoric acid salts, naphtalenesulfonic acid formalin condensates, polyoxyethylene alkylphosphoric acid ester salts, glycerol borate fatty acid esters, and so on.

Examples of the nonionic surfactant include polyoxyethylene alkyl ethers, polyoxyethylene oxypropylene block copolymers, sorbitan fatty acid esters, glycerin fatty acid esters, polyoxyethylene fatty acid esters, polyoxyethylene alkylamines, fluorine-containing surfactants, silicon-containing surfactants, and so on. Examples of the cationic surfactant include alkylamine salts, quaternary ammonium salts, alkylpyridinium salts, and alkylimidazolium salts. Examples of the amphoteric surfactant include alkylamine oxides, phosphadylcholines, and so on.

As the dispersing resin, it is possible to use any resin as long as it has water solubility or water dispersibility. Particularly preferable among those is a dispersing resin whose weight average molecular weight is 1,000 or more and 100,000 or less, and more preferable is a dispersing resin whose weight average molecular weight is 3,000 or more and 50,000 or less.

Specifically, the following can be used as the dispersing resin, for example: Styrene, vinyl naphthalene, aliphatic alcohol ester of α, β-ethylenically unsaturated carboxylic acid, acrylic acid, maleic acid, itaconic acid, fumaric acid, vinyl acetate, vinyl pyrrolidone, acrylamide, or polymers using derivatives of these materials or the like as monomers. Note that one or more of the monomers constituting any of the polymers are preferably hydrophilic monomers, and a block copolymer, a random copolymer, a graft copolymer, a salt thereof, or the like may be used. Alternatively, a natural resin such as rosin, shellac, or starch can be used as well.

In the present embodiment, it is preferable that an aqueous ink contain a dispersant for dispersing the silver particles and that the mass ratio of the content (% by mass) of the dispersant to the content (% by mass) of the silver particles is 0.02 or more and 3.00 or less.

In a case where the mass ratio is less than 0.02, the dispersion of the silver particles is unstable, and the ratio of the silver particles that get attached to heat generating portions of the print head 130 increases. This in turn increases the likelihood of abnormal bubble generation and may result in print twists due to ink overflow. On the other hand, in a case where the mass ratio is more than 3.00, the dispersant may hinder the fusion of the silver particles during image formation and thereby lower the metallic glossiness of the image.

Surfactant

The ink containing the silver particles used in the present embodiment preferably contains a surfactant in order to achieve more balanced ejection stability. As the surfactant, the above-described anionic surfactants, nonionic surfactants, cationic surfactants, or amphoteric surfactants can be used.

Among them, any of the nonionic surfactants is preferably contained. Among the nonionic surfactants, particularly preferable are a polyoxyethylene alkyl ether and an acetylene glycol ethylene oxide adduct. The hydrophile-lipophile balance (HLB) of these nonionic surfactants is 10 or more. The content of the thus used surfactant in the ink is preferably 0.1% by mass or more. Also, the content is preferably 5.0% by mass or less, more preferably 4.0% by mass or less, and further preferably 3.0% by mass or less.

Aqueous Medium

For the ink containing the silver particles used in the present embodiment, it is preferable to use an aqueous medium containing water and a water-soluble organic solvent. The content (% by mass) of the water-soluble organic solvent in the ink is 10% by mass or more and 50% by mass or less and more preferably 20% by mass or more and 50% by mass or less based on the entire mass of the ink. The content (% by mass) of the water in the ink is preferably 50% by mass or more and 88% by mass or less based on the entire mass of the ink.

Specifically, the following can be used as the water-soluble organic solvent, for example: alkyl alcohols such as methanol, ethanol, propanol, propanediol, butanol, butanediol, pentanol, pentanediol, hexanol, and hexanediol; amides such as dimethylformamide and dimethylacetamide; ketones or keto alcohols such as acetone or diacetone alcohol; ethers such as tetrahydrofuran and dioxane; polyalkylene glycols having an average molecular weight of 200, 300, 400, 600, 1,000, or the like such as polyethylene glycol and polypropylene glycol; alkylene glycols having an alkylene group having two to six carbon atoms such as ethylene glycol, propylene glycol, butylene glycol, triethylene glycol, 1,2,6-hexanetriol, thiodiglycol, hexylene glycol, and diethylene glycol; lower alkyl ether acetates such as polyethylene glycol monomethyl ether acetate; glycerin; and lower alkyl ethers of polyhydric alcohols such as ethylene glycol monomethyl (or ethyl) ether, diethylene glycol methyl (or ethyl) ether, and triethylene glycol monomethyl (or ethyl) ether. Also, as the water, deionized water (ion-exchanged water) is preferably used.

Print Medium

The print medium in the present embodiment has a base material and at least one ink receiving layer. In the present embodiment, the print medium is preferably an inkjet print medium for use in inkjet printing methods.

Mechanism of How Silver Printed Region Appears Brownish

The mechanism of how a silver printed region appears brownish will be described with reference to FIGS. 4A to 7B. The Me ink containing the silver particles used in the present embodiment (this ink may be called silver ink) is a brownish liquid because particular wavelengths of light are absorbed due to a phenomenon called localized surface plasmon resonance in which the oscillation of free electrons inside the metal exposed to the electric field of the light (plasmon) and the oscillation of the light resonate with each other. The wavelengths absorbed by this localized surface plasmon resonance vary by the particle shape and size. With the silver particles used in the present embodiment, the extinction spectrum peaks on a low-wavelength side of the visible light range, and therefore the Me ink is a liquid appearing brownish due to the localized surface plasmon resonance.

Figure 4A:
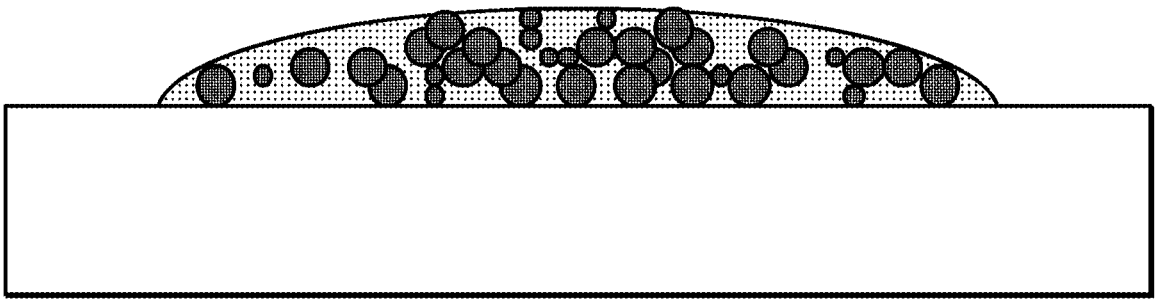
FIGS. 4A to 4C are schematic diagrams showing silver particles in the process of forming a fused film.
Figure 4B:
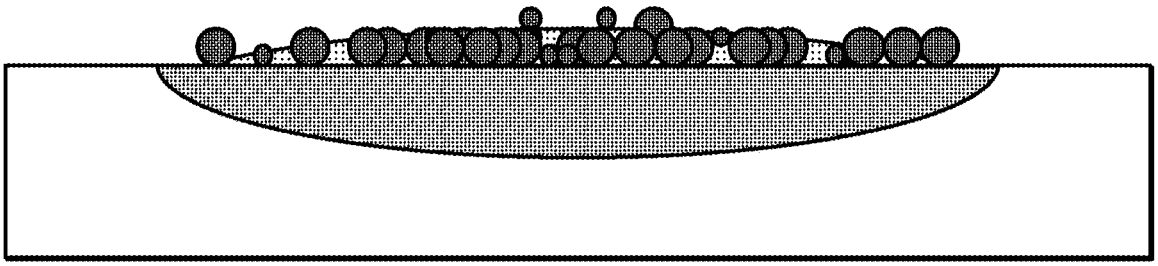
Figure 4C:
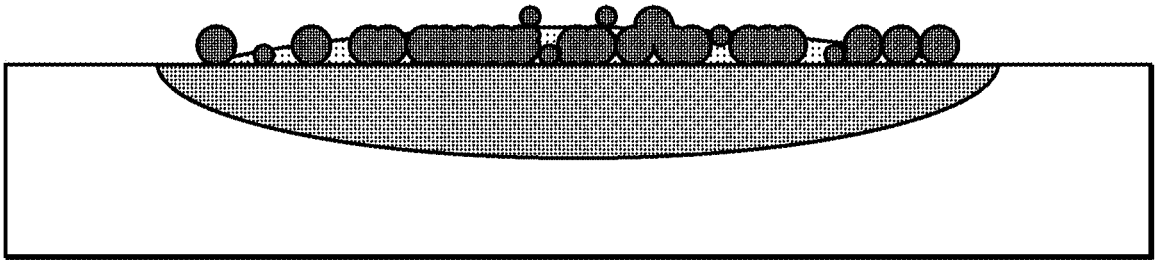

FIGS. 4A to 4C are diagrams explaining the mechanism of how a dot of the Me ink appears brownish. FIG. 4A is a schematic diagram showing a cross section at a moment when the Me ink has landed on a paper surface. The cross-sectional shape of the Me ink is a dome shape due to the surface tension of the ink. Also, the silver particles are evenly dispersed inside this dome-shaped ink.

FIG. 4B shows a state where the aqueous medium of the Me ink has permeated the print medium and the silver particles are trapped on the surface of the print medium. Since the ink before the permeation of the aqueous medium is in the dome shape, the number of silver particles on the print medium per unit area increases toward the center of the dot and decreases toward the outer periphery of the dot. As the aqueous medium permeates the print medium, the silver particles floating in the aqueous medium land on the surface of the print medium directly below. Thus, the density of the silver particles on the surface of the print medium increases toward the center of the dot and decreases toward the outer periphery of the dot.

FIG. 4C is a diagram showing a state where silver particles trapped on the surface of the print medium have fused to one another. Since the silver particles fuse to one another via contact between the particles, the fusion is more likely to occur in a region where the density of silver particles is higher. Hence, in a region closer to the outer periphery of the dot, the density of silver particles is lower and the number of isolated silver particles is larger, and thus the likelihood of occurrence of fusion is lower than that in a center region of the dot.

Figure 5A:
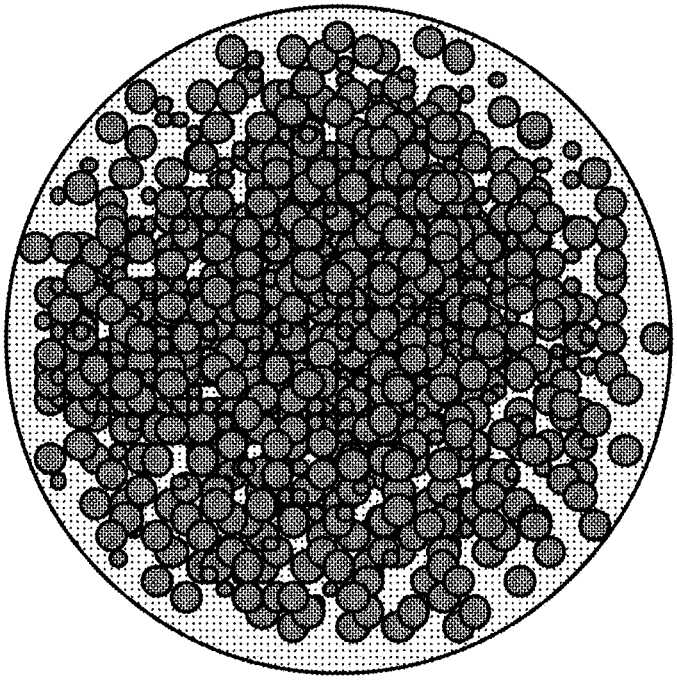
FIGS. 5A and 5B are schematic diagrams showing contacting portions of silver particles in the process of forming a fused membrane.
Figure 5B:
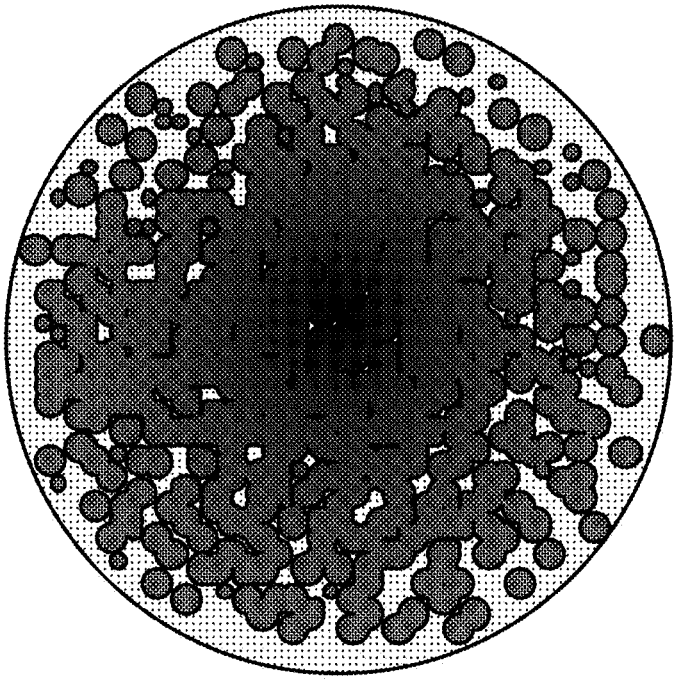

FIGS. 5A and 5B are schematic diagrams showing states where a single dot of the Me ink is printed on a print medium. FIG. 5A is a schematic diagram showing the distribution of density of the silver particles after the permeation of the aqueous medium. FIG. 5B is a schematic diagram showing a state where contacting portions of silver particles have fused to form a silver film. At the outer periphery of the dot, there are silver particles that have not contacted and thus not fused to others. In a case where the silver in the Me ink used in the present embodiment fails to fuse and remains in the particle form, the silver appears brownish due to the above-mentioned localized surface plasmon resonance. Consequently, the brownish color due to the localized surface plasmon resonance remains at the outer periphery of the Me dot, at which fusion is less likely to occur. The above is a description of the mechanism of how an Me dot appears brownish.

Figure 6:
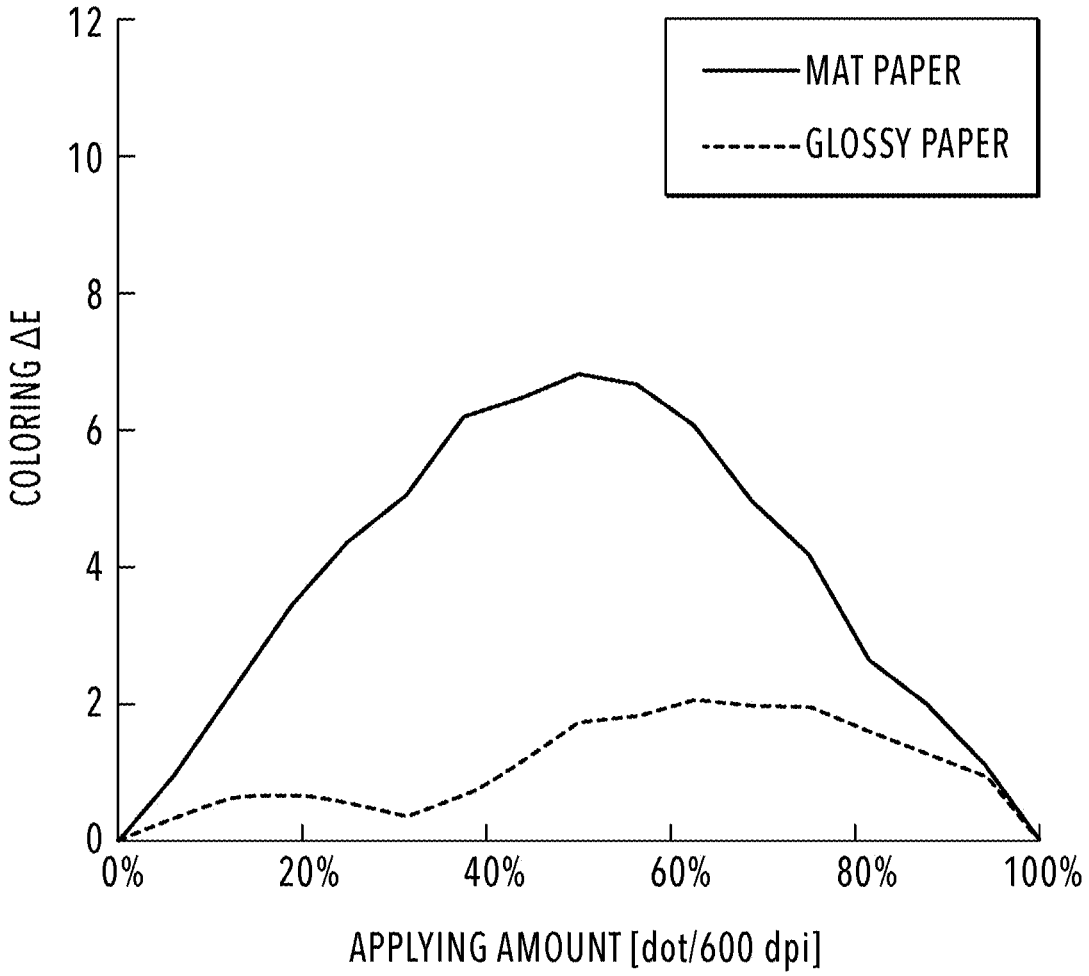
FIG. 6 is a diagram showing degrees of coloring in cases where gradations are generated using an Me ink.

FIG. 6 is a diagram showing degrees of the brownish coloring in cases where gradations are generated using the Me ink. In the example of the inkjet printing apparatus in the present description, graininess is usually rendered less visually recognizable. To do so, each gradation is generated by using a dot arrangement provided with a blue noise characteristic to the extent possible.

Meanwhile, the print media used are mat paper (solid line) used as kraft paper or the like, and glossy paper (dashed line) used as photographic paper or the like.

The horizontal axis represents the Me ink applying amount, and a state where a single dot is printed at 600 dpi is 100%. The vertical axis represents a coloring degree ΔE being the distance from a* and b* being the color of the Me ink in the non-colored state in the a*–b* plane of an Lab color space. In the present description, the color in the non-colored state corresponds to a* and b* values on a straight line in the Lab space connecting the L*, a*, and b* values of the silver in a state where the Me ink is sufficiently applied so as to ensure fusion of the silver particles, and the L*, a*, b* values of the paper white color. The state where the Me ink is sufficiently applied corresponds to, for example, about 11 ng of the Me ink per pixel at 600 dpi.

Specifically, with ($L_m$, $a_m$, $b_m$), ($L_w$, $a_w$, $b_w$), and ($L_e$, $a_e$, $b_e$) as the L*, a*, b* values of the silver in the state where the Me ink is sufficiently applied, the paper white color, and the evaluation target respectively, the coloring degree ΔE is calculated as the equation (1) below.

$$\Delta E=[\{a^*_m(L_e)-a_e\}^2-\{b^*_m(L_e)-b_e\}^2]^{0.5} \quad (1)$$

Here, the following are given:

| | |
|---|---|
| (The equation of a straight line for a*) | $a^*_m(L^*) = a_a \times L^* + b_a$ |
| (Slope) | $a_a = (a_m - a_w)/(L_m - L_w)$ |
| (Intercept) | $b_a = a_w - a_a \times L_w$ |
| (The equation of a straight line for b*) | $b^*_m(L^*) = a_b \times L^* + b_b$ |
| (Slope) | $a_b = (b_m - b_w)/(L_m - L_w)$ |
| (Intercept) | $b_b = b_w - a_b \times L_w$ |

Referring to FIG. 6 again, it can be seen that the coloring is strong at intermediate tones of gradation with both the mat paper and the glossy paper. This is because the metallic tone representations are printed by dispersing dots as much as possible with use of dispersed dot arrangements such as blue noise, and accordingly the number of isolated dots is large and the ratio of Me dots with brownish outer peripheries is large. The coloring is low in a range where the density of gradation is high because the brownish outer peripheries of dots are overlapped by other neighboring dots, so that the silver particles at the brownish outer peripheries fuse to silver particles contained in the ink droplets of the other dots or the brownish color is covered by the fused silver film formed by the other dots.

The above finding indicates that making the outer peripheries of Me dots overlapped by other Me dots is effective in reducing the coloring. Here, the outer peripheries of neighboring dots can overlap each other by being arranged adjacently in a matrix if each dot is larger than the size of a printing pixel. However, the outer peripheries cannot overlap each other if each dot is smaller than the size of a printing pixel. Also, for low tones, there is a problem in that arranging dots adjacently in a matrix increases the graininess. From the above reasons, in the present embodiment, an Me dot is formed by laying the Me ink a plurality of times at the same coordinates (same pixel position) in a plurality of printing scans. Forming an Me dot by laying the Me ink a plurality of times at same coordinates in a plurality of printing scans increases the density of silver particles per dot, and accordingly promotes the fusion of the silver and reduces the coloring.

Figure 7A:
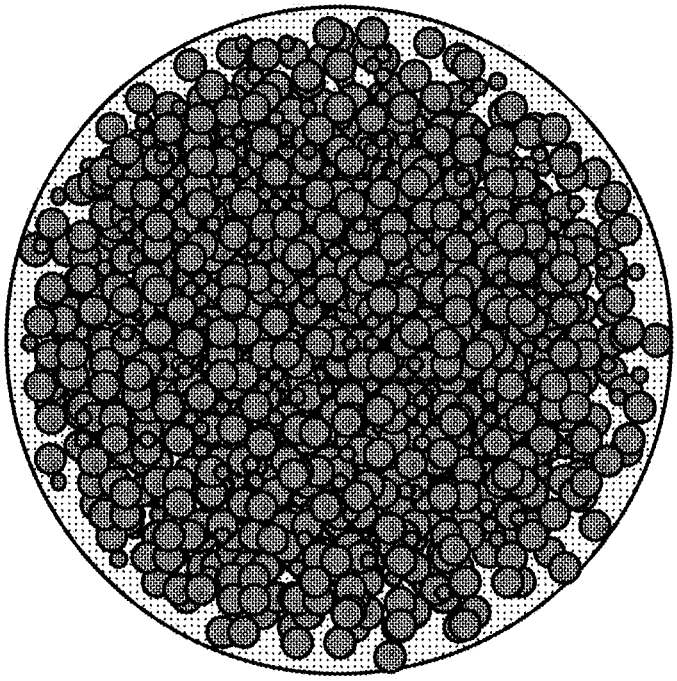
FIGS. 7A and 7B are schematic diagrams showing silver particles for two dots in the process of forming a fused membrane.
Figure 7B:
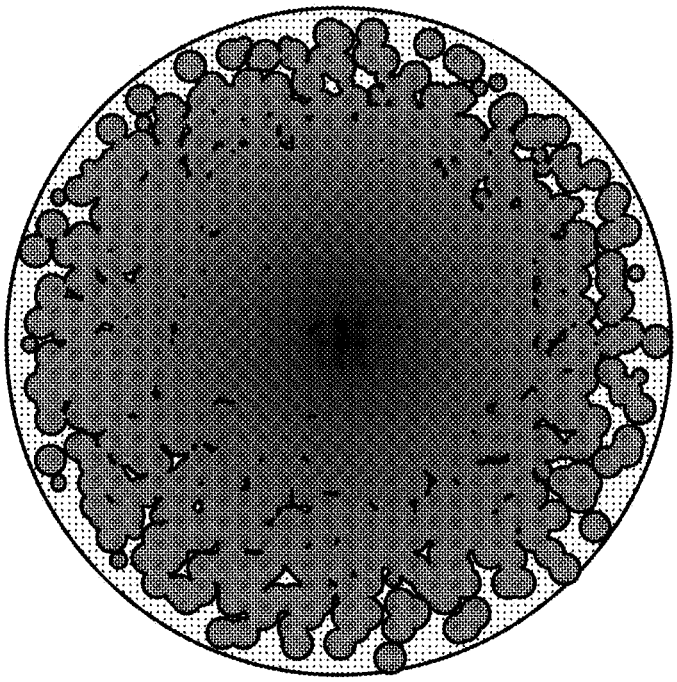

FIGS. 7A and 7B are schematic diagrams showing states of an Me dot obtained by printing an Me dot twice at the same coordinates. An advantageous effect achieved by printing an Me dot twice at same coordinates will be described with reference to FIGS. 7A and 7B. FIG. 7A is a diagram showing the distribution of density of silver particles after the permeation of the aqueous medium, and indicates that the density of silver particles is higher than that in FIG. 5A. On the assumption that the dot diameter remains substantially the same even after laying two dots, the density of silver particles within the dot is twice higher. FIG. 7B is a diagram showing a state where contacting portions of the silver particles in FIG. 7A have fused to form a film. FIG. 7B indicates that the silver fused film is formed closer to the outer periphery of the dot than is the fused silver film in FIG. 5B. This also reduces the coloring of the outer peripheral portion of the dot.

As described above, the coloring is reduced while increase in graininess is suppressed regardless of the size of an Me dot by printing Me dots one over another at same coordinates in a plurality of printing scans.

Note that the evaluation value ΔE of the degree of the coloring is not limited to the evaluation value in the present description. In an example, simply $a^*_m=0$ and $b^*_m=0$ may be used instead of $a^*_m(L^*)$ and $b^*_m(L^*)$.

First Embodiment

In light of the above finding, in a first embodiment, a description will be given of an example of superimposing the Me ink on a print medium in the printing apparatus. In the first embodiment, a configuration that prints Me dots one over another at the same coordinates in two printing scans will be described with reference to FIG. 8 to FIG. 10B.

Print Data Generation Process

Figure 8:
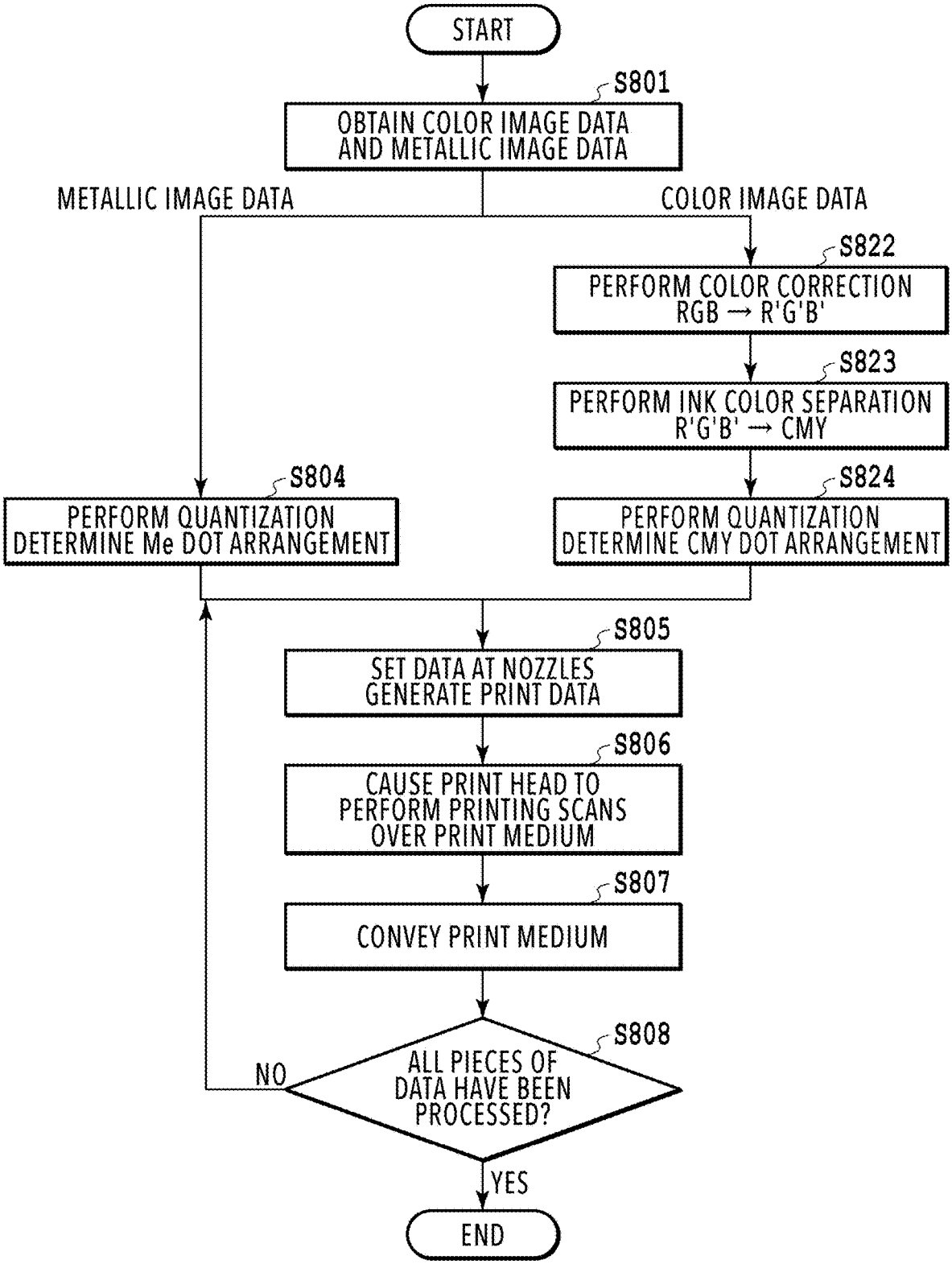
FIG. 8 is a flowchart showing a print data generation process and a printing operation.

FIG. 8 is a flowchart explaining a process of generating print data based on image data (referred to as the print data generation process) and a printing operation executed by the main control unit 11 of the printing apparatus 1 in the present embodiment. The CPU installed in the main control unit 11 of the printing apparatus 1 deploys a program stored in the ROM into the RAM and executes the deployed program. As a result, each process in FIG. 8 is executed. Alternatively, the functions of some or all of the steps in FIG. 8 may be implemented with hardware such as an ASIC and an electronic circuit. Meanwhile, the symbol "S" in the description of each process means a step in the flowchart.

In S801, the main control unit 11 obtains color image data and metallic image data transmitted from the image processing apparatus 2. The color image data indicates the tones in a color image while the metallic image data indicates the tones in a metallic image. Thereafter, the color image data and the metallic image data are each processed. It is to be noted that in FIG. 8 a process block is set for each group of processes in order to facilitate understanding. A process block into which a plurality of arrows are inputted (e.g., S805) is a process block whose processes are started in response to completion of the processes in each of the blocks outputting the arrows (the same applies below to the flowcharts herein). In the flowchart of FIG. 8, parallel processing may be performed, or the color image data and the metallic image data may be sequentially processed.

In S822, the main control unit 11 executes a process of converting the color image data obtained in S801 into image data supporting the color gamut of the printing apparatus 1 (color correction process). In an example, by this step, image data in which each pixel has an 8-bit value for each of R, G, and B channels is converted into image data in which each pixel has a 12-bit value for each of R', G', and B' channels. In the conversion in this step, a publicly known technique may be used such as performing matrix calculation processing or referring to a three-dimensional look-up table (hereinafter 3DLUT) stored in the ROM or the like in advance. Note that the metallic image data obtained in S801 corresponds to a grayscale image whose tones are to be expressed with eight bits by the printing apparatus 1, and a color correction process equivalent to that in this step is not performed on the metallic image data.

In S823, the main control unit 11 executes a process of separating the image data derived in S822 into pieces of image data of the respective ink colors (referred to as the ink color separation process). In an example, by this step, the image data in which each pixel has a 12-bit value for each of the R', G', and B' channels is separated into pieces of image data of the ink colors to be used in the printing apparatus 1 (i.e., pieces of 16-bit tone data of C, M, and Y). Meanwhile, in this step too, a publicly known technique may be used such as referring to a 3DLUT stored in the ROM or the like in advance, as in S822. Note that the metallic image data obtained in S801 corresponds to an eight-bit grayscale image for the printing apparatus 1, and a color separation process equivalent to that in this step is not performed on the metallic image data.

In S824, the main control unit 11 performs a predetermined quantization process on the tone data for each ink to thereby convert the tone data into one-bit quantized data. Specifically, a signal value for each ink is converted into an ejection level specifying an ink ejection volume per unit area. In a case where binary quantization is performed for example, the tone data of each of C, M, and Y is converted by this step into one-bit data in which each pixel has a value of either 0 or 1 as an ejection level.

Also, in S804, the main control unit 11 performs a predetermined quantization process on the metallic image data to thereby convert this tone data into one-bit quantized data. Specifically, a signal value for each ink is converted into an ejection level specifying an ink ejection volume per unit area. In a case where binary quantization is performed for example, the Me tone data is converted by this step into one-bit data in which each pixel has a value of either 0 or 1 as an ejection level.

By S824 and S804, a final arrangement of dots on a paper surface is determined, and dot data is generated for each of the C (cyan), M (magenta), Y (yellow), and Me (metallic) inks. In a case where the print head 130 is capable of arranging dots on a paper surface at a resolution of 600 dpi×600 dpi, whether to arrange a dot is determined for each set of coordinates obtained by partitioning the paper surface into a 600 dpi×600 dpi grid pattern.

In S805, the main control unit 11 generates print data for a single scan from the dot data for each ink generated in S804 and S824, and sets the print data at a predetermined region in the corresponding one of the C (cyan), M (magenta), Y (yellow), and Me (metallic) nozzle arrays. Then in S806, the main control unit 11 performs actual printing on a print medium with the print data for the single scan generated in S805. Meanwhile, feed of the print medium (not shown) is performed prior to the printing with the first scan.

In S807, the main control unit 11 conveys the print medium. The specific contents of the nozzle positions used within the nozzle arrays, the amount of conveyance, and so on in S805 to S807 will be described in <Description of Printing Operation> to be discussed later. In S808, the main control unit 11 determines whether the processing of all pieces of print data and the corresponding printing scans have been completed. If the result of the determination is yes, discharge of the printing medium (not shown) and so on are performed, and the processing is terminated. If not all pieces of print data have been processed, the main control unit 11 returns to S805 and repeats the processes.

Note that while the main control unit 11 of the printing apparatus 1 executes each process in FIG. 8 in the above description, the present embodiment is not limited to this configuration. Specifically, the main control unit 21 of the image processing apparatus 2 may execute all or some of the processes in FIG. 8. The above is the contents of the print data generation process and the printing operation in the present embodiment.

Description of Printing Operation

Next, an example of a specific printing operation in the present embodiment will be described. In image formation, the print head 130 is caused to eject each ink while being scanned along the main scanning direction. Then, after a single main scan is completed, the print medium is conveyed along a sub scanning direction (−y direction). By repeating a main scan of the print head 130 and an operation of conveying the print medium as above, images are formed on the print medium in a step-by-step manner.

In the present embodiment, the chromatic color inks and the Me ink are ejected onto a same region on the print medium at different timings in order to obtain a metallic color expression. Here, attention is to be paid to these timings. Specifically, the Me ink is ejected first, and the chromatic color inks are then ejected after a certain time interval or longer. Providing such a time interval ensures permeation of the aqueous medium contained in the Me ink into the print medium, evaporation of the aqueous medium, and fusion of silver particles. By laying the chromatic color inks over the Me ink in such a state, a fine metallic color is obtained.

Figure 9:
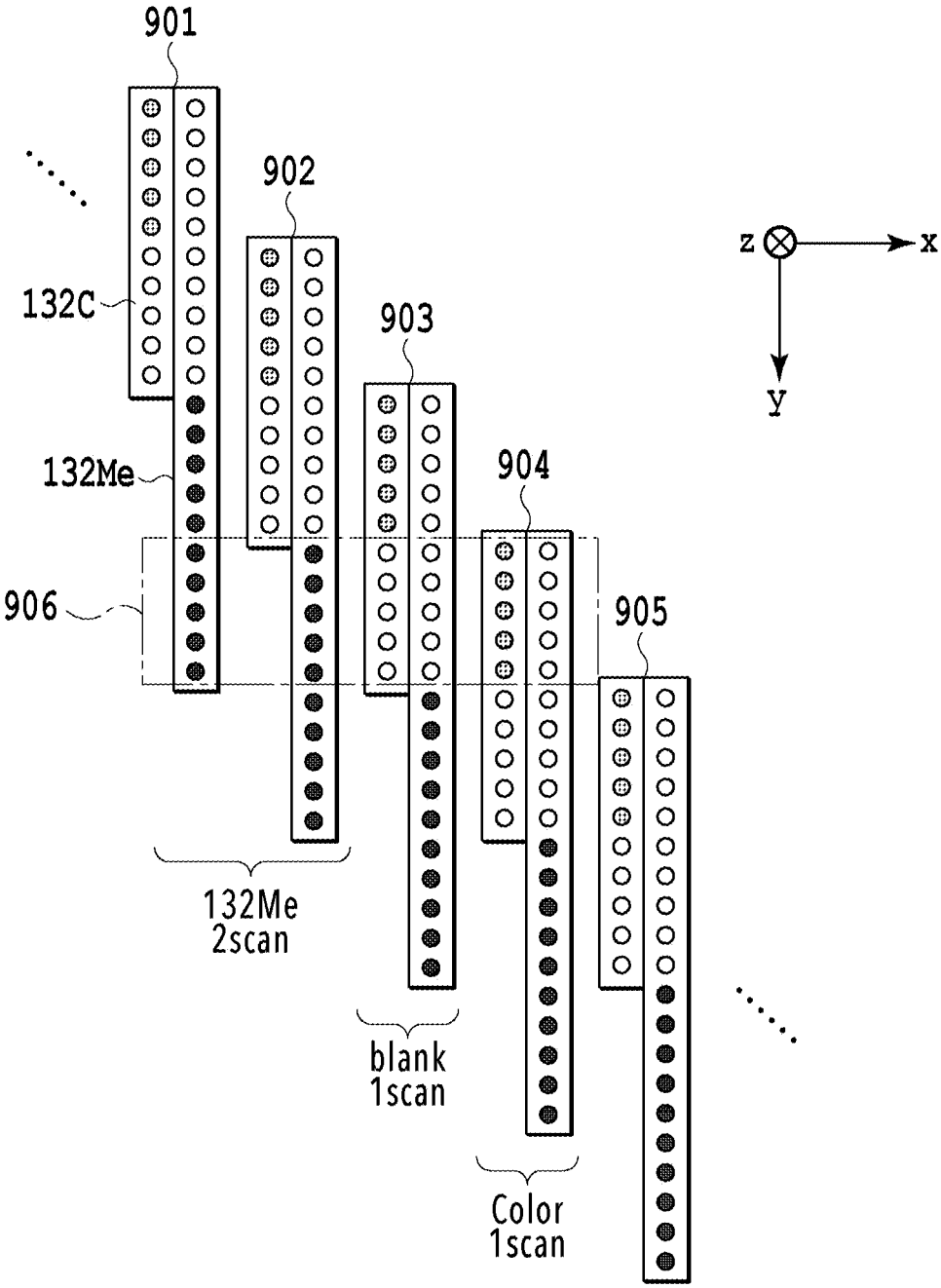
FIG. 9 is a diagram showing the printing operation.

FIG. 9 is a diagram explaining the specific printing operation in the present embodiment. States 901 to 905 show the relative positional relationships between the nozzle arrays 132C, 132M, 132Y, and 132Me above a print medium and the print medium in the y direction in five printing scans in the present embodiment in the order of the five printing scans. Note that in practice the print medium is conveyed in the −y direction (conveyance direction), but FIG. 9 shows a diagram in which the print medium is fixed in the y direction and the nozzle arrays are moved in order to facilitate understanding. Illustration of the nozzle arrays 132M and 132Y is omitted, and the nozzle array 132C is representatively illustrated since the color nozzle arrays 132C, 132M, and 132Y have the same nozzle positions in the y direction. In FIG. 9, the nozzle array 132C and the nozzle array 132Me are shown on the left side and the right side in the states 901 to 905, respectively. The hatched portions of the nozzle array 132C and the shaded portions of the nozzle array 132Me indicate the positions of nozzles used among the nozzles in the color nozzle array (referred to as the color nozzles) and the nozzles in the metallic nozzle array (referred to as the Me nozzles) in the present embodiment.

In the example of FIG. 9, the 5 nozzles in the nozzle array 132C from its end in the −y direction are used, and the 10 nozzles in the nozzle array 132Me from its end in the y direction are used. Note that in each nozzle array, the nozzles present on the y-direction end side from the center will be referred to as the conveyance-direction upstream nozzles (also referred to simply as the upstream nozzles). On the other hand, the nozzles present on the −y-direction end side from the center will be referred to as the conveyance-direction downstream nozzles (also referred to simply as the downstream nozzles). In the example of FIG. 9, the amount of conveyance of the print medium is set at an amount corresponding to five nozzles to thereby enable ejection of the Me ink first and then ejection of the chromatic color ink.

Also, in the present embodiment, as shown in FIG. 9, there are sets of 5 nozzles between the nozzles that actually eject the Me ink (the 10 downstream nozzles) and the nozzles that actually eject the chromatic color ink (the 5 upstream nozzles). Specifically, the sets of five nozzles between the nozzles that actually eject the Me ink and the nozzles that actually eject the chromatic color ink are controlled not to eject the inks. This region in which neither the Me ink nor the chromatic color ink is ejected will be referred to as a "blank nozzle region". Providing the blank nozzle region enables application of the Me ink and the chromatic color ink with a sufficient time interval therebetween. Note that as this blank nozzle region (the number of nozzles controlled not to eject the inks), a suitable region can be set as appropriate according to the scan speed of the print head, the conveyance speed of the print medium, and the like.

In the case illustrated in FIG. 9, a time interval equivalent to at least a single main scan is provided from the application of the Me ink to the application of the chromatic color ink. Thus, a sufficient time is ensured for the fusion of the silver particles in the Me ink applied onto the print medium. This enables reliable formation of an Me ink layer and a chromatic color ink layer on the print medium and hence enables a metallic color expression with fine glossiness and saturation.

By studying a dashed line section 906 in FIG. 9 from left, it can be seen that a predetermined region is printed in four printing scans. Specifically, it can be seen that the region is printed through a first Me-ink scan, a second Me-ink scan, a blank scan, and a first chromatic-color-ink scan in this order. The blank scan is a scan in which no ink is actually ejected. In other words, as for the Me ink, the predetermined region is printed in two printing scans. The number of these printing scans may be expressed as "passes". That is, it is possible to say that the Me ink is printed in two passes.

As for the scan direction of each scan, it is preferable to perform unidirectional printing, with which dot misalignment between scans is less. In a case where productivity is given priority, bidirectional printing may be performed in which forward-direction printing and backward-direction printing are performed alternately. In the case where the bidirectional printing is performed, the first dot and the second dot are more likely to be misaligned. This increases the dot outer diameter and thus tends to lower the density of silver particles per unit area. Accordingly, the coloring reduction effect is lower than that with the unidirectional printing.

Figure 10A:
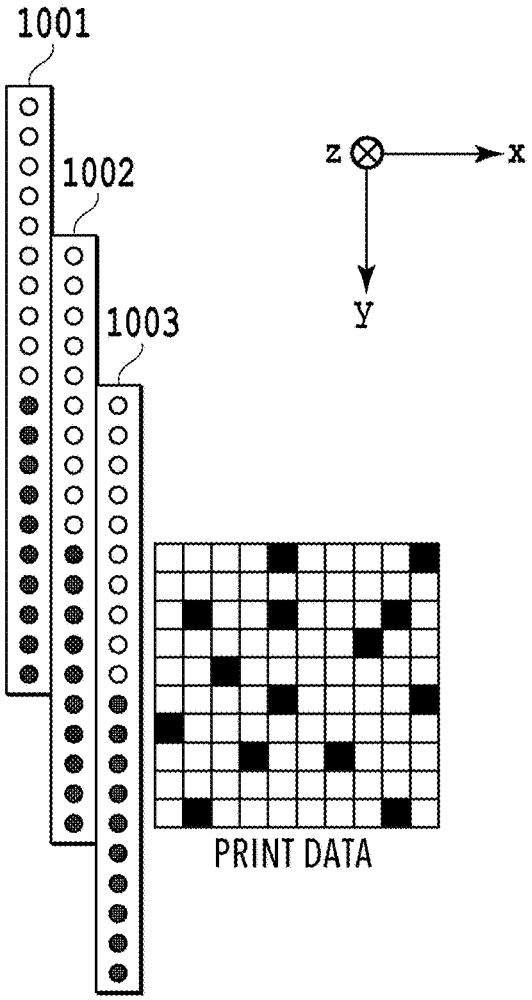
FIGS. 10A and 10B are diagrams showing how Me dots are formed.
Figure 10B:
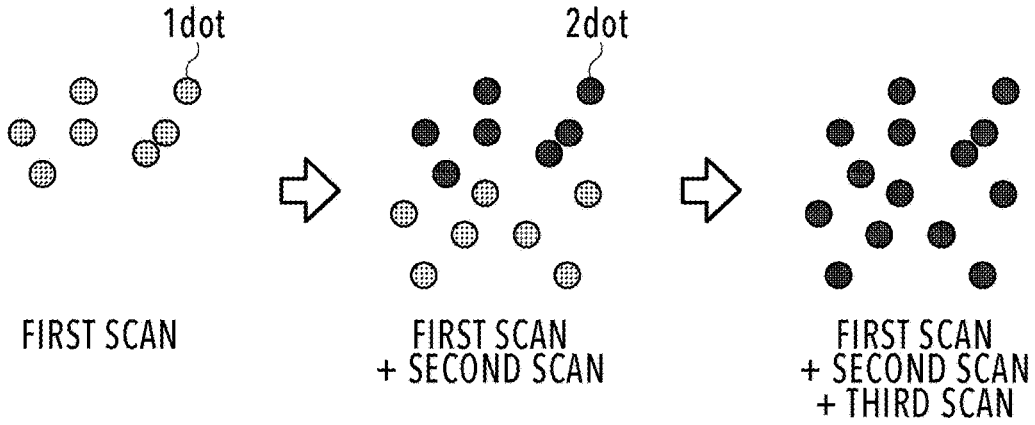

FIGS. 10A and 10B are diagrams showing how Me dots are formed by printing the Me ink print data generated in S804 with the above-described printing operation. FIG. 10A shows three printing scans 1001 to 1003 of the metallic nozzle array 132Me and print data corresponding to the used Me nozzle regions in the nozzle array 132Me in each scan. FIG. 10B shows how the print data shown in FIG. 10A are sequentially printed. FIG. 10B shows how Me dots are laid one over another through the first scan, the first scan+the second scan, and the first scan+the second scan+the third scan sequentially from left. Each dot depicted with lighter hatching represents one dot, while each dot depicted with darker hatching represents a dot formed of two dots laid on top of each other. FIGS. 10A and 10B show that by performing such a printing operation, every Me dot is printed with two dots laid at substantially same coordinates (substantially same pixel position).

Figure 11:
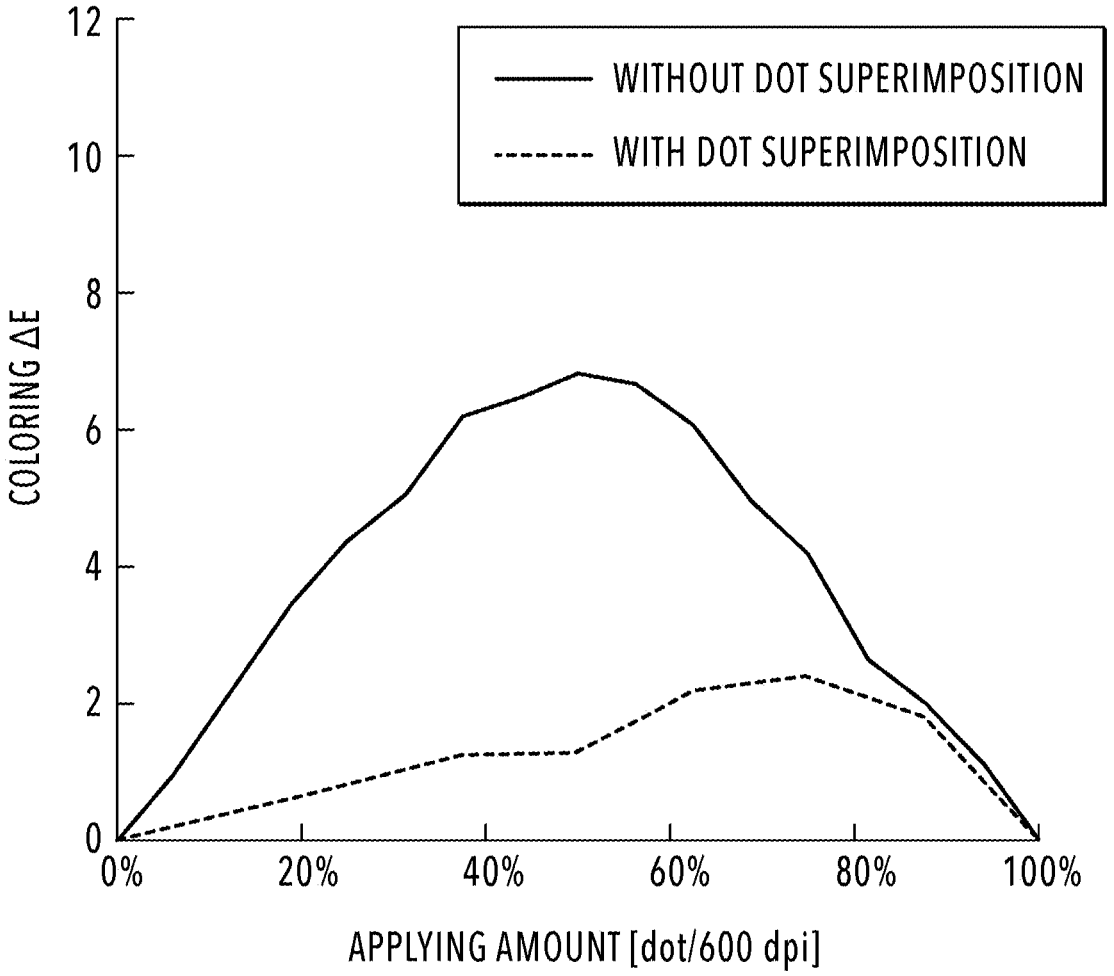
FIG. 11 is a diagram comparing degrees of the coloring.

FIG. 11 is a diagram showing an advantageous effect by the present embodiment. The solid line represents the degrees of the coloring in the case of printing the gradations on mat paper explained in FIG. 6. The dashed line represents the degrees of the coloring in a case where two dots are laid on top of each other in the above-described two printing scans to print the dots in the gradations on the mat paper shown by the solid line. The horizontal axis of FIG. 11 represents the average applying amount per pixel. FIG. 11 shows that the degree of the coloring is lower with the gradations generated by laying two dots (dashed line) on top of each other than with the gradations generated by single dots (solid line). In sum, performing Me printing as described in the present embodiment reduces the coloring while suppressing increase in graininess.

Note that although two Me dots are laid on top of each other in two printing scans in the description of the present embodiment, the number of times a printing scan is performed and the number of laid Me dots are not limited to the above numbers. Specifically, it suffices that the Me ink is ejected in two or more printing scans at a same pixel position to form a superimposed Me dot.

Second Embodiment

In the first embodiment, a description has been given of an example where two printing scans are performed to superimpose the Me ink on a print medium in order to reduce the coloring of the Me ink. It is conceivable to form an image with a larger number of printing scans in order to reduce image deterioration due to failure to eject the Me ink from Me nozzles or variation in ejection volume and thereby improve the printing quality of the Me ink. Multi-printing scanning carried out by performing a plurality of printing scans is also referred to as multi-pass printing. For example, in multi-pass printing, an image in a predetermined region is printed in N (N≥3) printing scans or more over the predetermined region. Performing the multi-pass printing may result in a failure to achieve a sufficient effect on the coloring for a predetermined printing target pixel in a case where there is a large printing scan order difference between the first-dot printing scan and the second-dot printing scan for the predetermined printing target pixel.

A second embodiment will describe a configuration that maintains the coloring reduction effect in a case where multi-pass printing is performed in which the number of passes for the Me ink is a predetermined number or more (e.g., three or more). Note that two dots are laid on top of each other (two printing scans are performed) for each pixel to form an Me dot in the pixel, as described in the first embodiment.

In a case of printing an image on an A4 print medium, a single scan requires 0.5 second on the assumption that the scan speed of the carriage 131 is 20 inches/sec and the scan width is approximately 10 inches. In a case of performing unidirectional printing, successive printing scans are interrupted by scanning of the carriage 131 back to the printing scan start position. Thus, the printing time interval between successive printing scans is practically about one second. Specifically, the printing time interval between two successive printing scans is approximately one second.

Assume multi-pass printing in which the Me ink is printed on a predetermined region in five printing scans, for example. Assume also a configuration in which two dots are laid on top of each other in each pixel to be printed with the Me ink by laying the first dot and the second dot on top of each other. In this case, the printing time interval between the first dot and the second dot for a predetermined pixel is approximately four seconds if the first dot and the second dot are allocated to the first scan and the fifth scan. In this example, the Me ink for the second dot lands on the first dot that has already dried since the time taken for a single Me ink dot to dry is approximately three to four seconds. In this case, it is difficult for the silver particles of the first dot and those of the second dots to fuse to each other. This is because once silver particles form a fused film, their melting point rises, thereby making it difficult for them to fuse to other silver particles.

In contrast, in a case of performing scanning in which the printing scans for the first dot and the second dot are close in order, the Me ink for the second dot lands before the first dot dries, so that the first dot and the second dot form a single ink droplet. This enables efficient fusion of the silver particles. Thus, in the case of performing multi-pass printing, the effect on the coloring is improved by minimizing the printing time interval between Me dots to be laid on top of each other.

In light of the above finding, in the present embodiment, a description will be given of an example where the printing time interval is reduced in order to suppress deterioration of the coloring reduction effect in the case of performing multi-pass printing of the Me ink.

Print Data Generation Process

The print data generation process in the second embodiment can be a process basically similar to the flowchart of FIG. 8 in the first embodiment. The difference from the first embodiment is that a process using later-described pass masks is performed in the print data generation in S805. The other processes are equivalent processes, and description thereof is therefore omitted.

Description of Printing Operation

Figure 12:
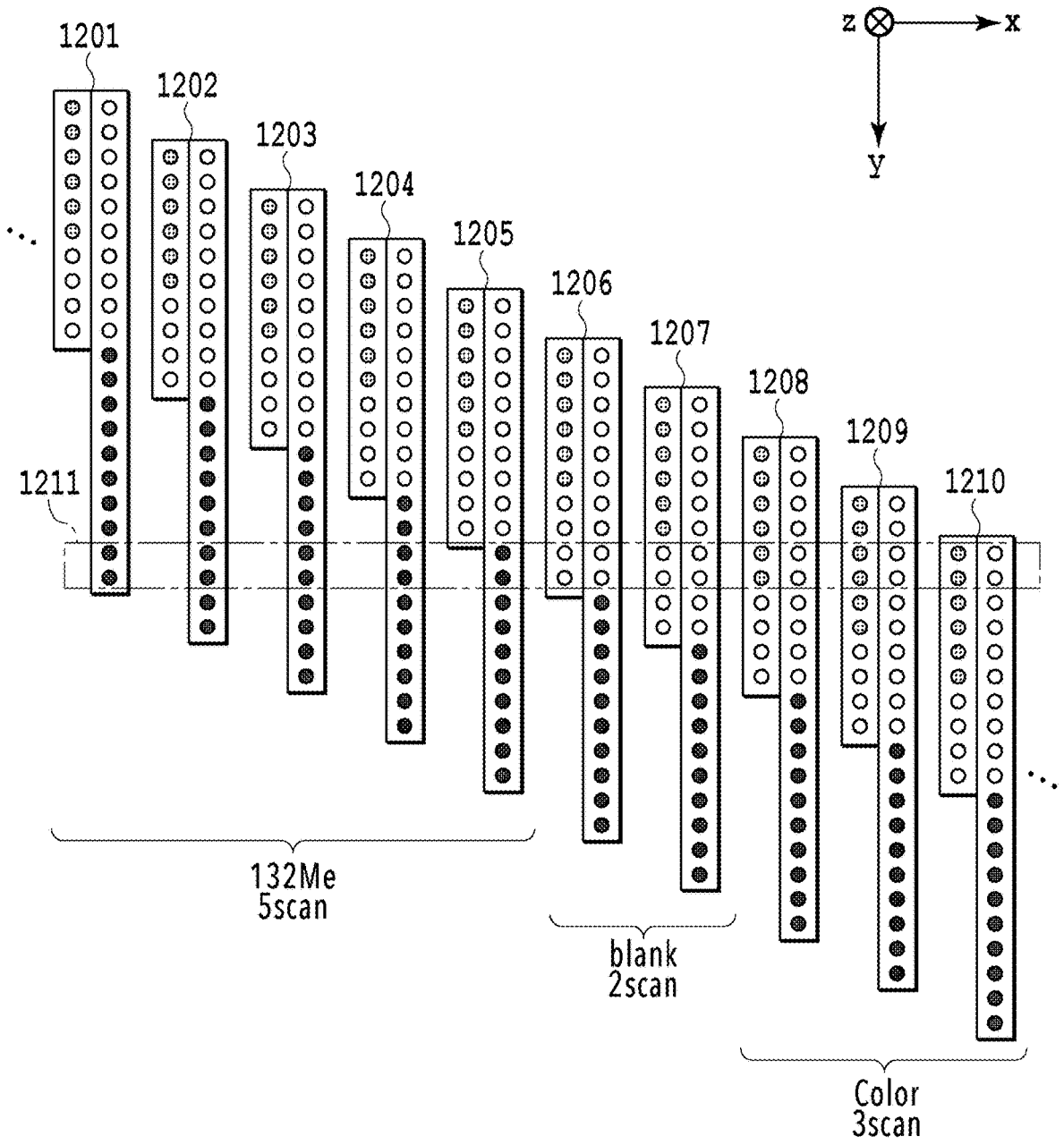
FIG. 12 is a diagram showing a printing operation.

FIG. 12 is a diagram explaining a specific printing operation in the present embodiment. States 1201 to 1210 show the relative positional relationships between the nozzle arrays 132C, 132M, 132Y, and 132Me above a print medium and the print medium in the y direction in 10 printing scans in the present embodiment in the order of the 10 printing scans. Illustration of the nozzle arrays 132M and 132Y is omitted, and the nozzle array 132C is representatively illustrated in FIG. 12 since the color nozzle arrays 132C, 132M, and 132Y have the same nozzle positions in the y direction. In FIG. 12, the nozzle array 132C and the nozzle array 132Me are shown on the left side and the right side in the states 1201 to 1210, respectively. The hatched portions of the nozzle array 132C and the shaded portions of the nozzle array 132Me indicate the positions of used nozzles among the color nozzles and the Me nozzles in the present embodiment. The 6 nozzles in the nozzle array 132C from its end in the −y direction are used, and the 10 nozzles in the nozzle array 132Me from its end in they direction are used. In the present embodiment, the amount of conveyance of the print medium is set at an amount corresponding to two nozzles to thereby enable ejection of the Me ink first and then ejection of the chromatic color ink.

Also, in the present embodiment, as shown in FIG. 12, there are sets of 4 nozzles between the nozzles that actually eject the Me ink (the 10 downstream nozzles) and the nozzles that actually eject the chromatic color ink (the 6 upstream nozzles). These sets of four nozzles are controlled not to eject the inks. By studying a dashed line section 1211 in FIG. 12 from left, it can be seen that a predetermined region is printed in 10 printing scans. Specifically, it can be seen that the region is printed through first to fifth Me-ink scans, first and second blank scans, and first to third chromatic-color-ink scans in this order. As for the scan direction of each scan, it is preferable to perform unidirectional printing, with which dot misalignment between scans is less, as in the first embodiment. The Me ink can be printed in five printing scans in the above manner.

Figure 13A:
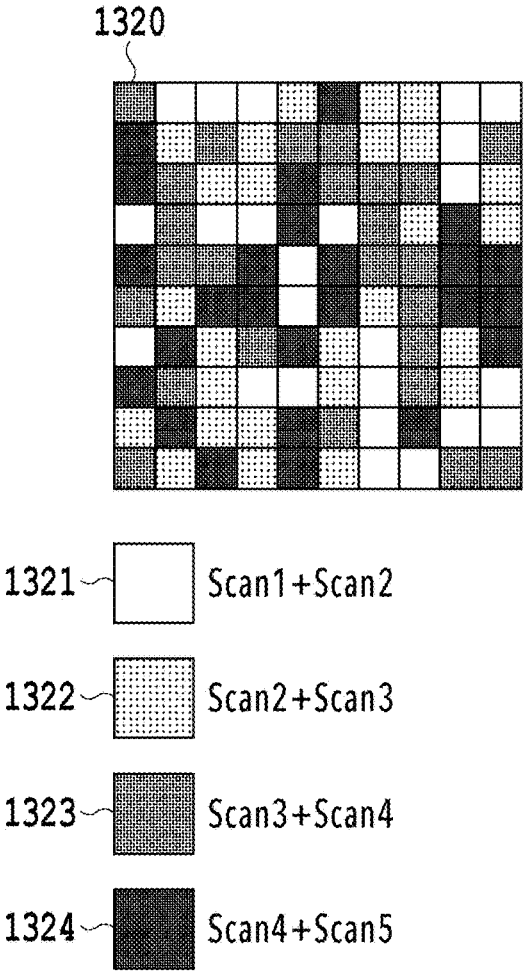
FIGS. 13A and 13B are diagrams explaining printing control.
Figure 13B:
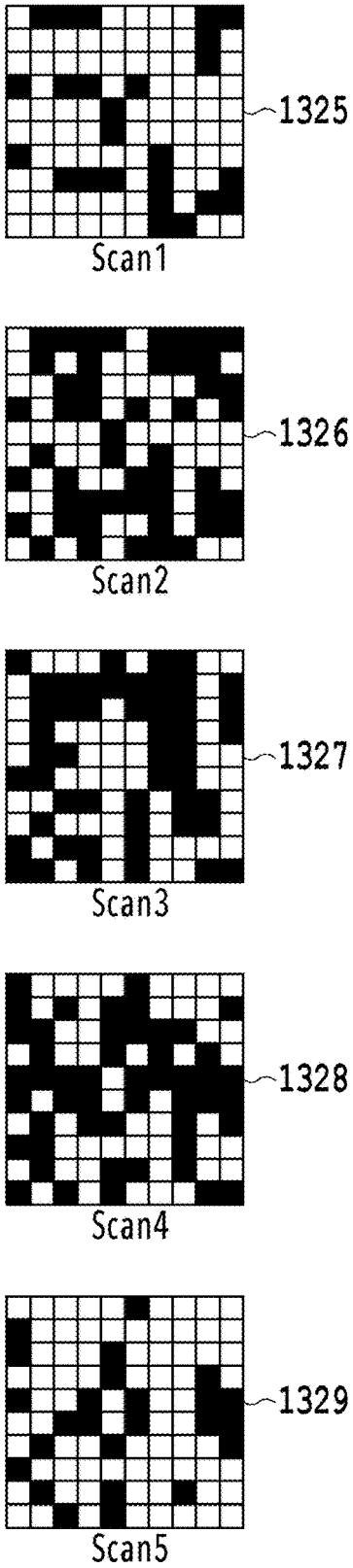

FIGS. 13A and 13B are diagrams explaining an example of controlling which scans among the five Me ink printing scans are to be used to print each pixel to be printed based on print data (hereinafter referred to as the printing target pixel). In the present embodiment, as described above, printing scans with the smallest possible printing scan order difference are performed as the Me ink printing scans. Specifically, in printing of the Me ink in each printing target pixel, the first-dot printing scan and the second-dot printing scan are controlled to be adjacent to each other in order. Print data is set for each printing scan by using publicly known pass mask control. FIG. 13A shows an arrangement indicating which printing scans among the five printing scans are to be used to print each pixel in a 10×10 pixel printing region. In FIG. 13A, four types of patterns 1321 to 1324 each covering certain pixels are used to identify which printing scans are to be used for printing. The pattern 1321 uses the first scan and the second scan for printing, the pattern 1322 uses the second scan and the third scan for printing, the pattern 1323 uses the third scan and the fourth scan for printing, and the pattern 1324 uses the fourth scan and the fifth scan for printing.

FIG. 13B is a diagram showing an example of pass masks generated based on FIG. 13A, and shows 10×10 pixel binary data sequences each indicating whether or not to perform printing in each printing scan. In mask patterns 1325 to 1329, the white pixels represent pixels at which ink ejection is prohibited while the black pixels represent pixels at which ink ejection is permitted. FIGS. 13A and 13B show that the pixels covered by the pattern 1321 in FIG. 13A corresponds to black pixels in the mask pattern 1325 and the mask pattern 1326 in FIG. 13B, which are allocated to the first scan and the second scan, respectively. The pixels covered by each of the patterns 1322 to 1324 in FIG. 13A likewise correspond to the black pixels in the mask patterns for the corresponding scans in FIG. 13B. Note that the 10×10 pixel mask patterns are shown in the present embodiment for the sake of explanation. The size of the mask patterns is not limited to this size. The first-dot printing scan and the second-dot printing scan can be controlled to be adjacent to each other in order by generating and allocating mask patterns in the above manner.

As described above, in the present embodiment, in multi-pass printing, mask control that keeps the landing time interval within a predetermined time is performed. This suppresses deterioration of the above-described coloring reduction effect while improving the printing quality of the Me ink.

Note that although two Me dots are laid on top of each other in five printing scans in the description of the present embodiment, the number of times a printing scan is performed and the number of laid Me dots are not limited to the above numbers. For example, the Me ink may be printed in 10 printing scans, and the number of laid Me dots may be 3. A dot formed by laying a plurality of Me dots on top of each other at the same coordinates will be referred to as a superimposed Me dot. That is, a superimposed Me dot may be formed by laying two or more Me dots on top of each other.

Also, in the present embodiment, a description has been given of a configuration in which two Me dots are laid on top of each other in temporally adjacent printing scans. However, the printing scans do not have to be temporally adjacent to each other as long as the landing time interval is kept within a predetermined time in the multi-pass printing. In an example, a predetermined printing target pixel may be printed in the first scan and the third scan.

Also, it is preferable that the landing time interval be kept within a predetermined time in multi-pass printing as described above for all printing target pixels to be printed with the Me dot, but the landing time interval may exceed the predetermined time for some of the pixels.

Consider classifying a superimposed-Me-dot printing target pixel by the printing scan order difference between any two printing scans. Assume, for example, a case where 2 Me dots are laid on top of each other in 10 printing scans, and an Me dot is printed in the fourth pass and the ninth pass for a predetermined printing target pixel. In this case, 9th pass−4th pass=5 passes, so that the printing scan order difference is 5 passes. In the case of performing two printing scans, five passes as the printing scan order difference for the superimposed Me dot printing target pixel represent one type. On the other hand, in a case where a superimposed Me dot includes three or more Me dots laid on top of each other, there can be a plurality of printing scan order differences with which to classify a superimposed Me dot printing target pixel.

A case of laying 3 Me dots on top of each other in 10 printing scans will be described. Assume a case where 3 Me dots are laid on top of each other in 10 printing scans, and an Me dot is printed in the first pass, the fourth pass, and the ninth pass for a predetermined printing target pixel. In this case, the printing scan order differences for the formation of the superimposed Me dot are 9th pass−4th pass=5 passes and 4th pass−1st pass=3 passes. Here, the three passes are the smaller printing scan order difference. Thus, the smallest printing scan order difference in the formation of this superimposed Me dot is three passes.

It is possible to employ a configuration in which Me dots are printed such that the number of pixels for which the smallest printing scan order difference calculated as above is a predetermined value (e.g., 3) or less is larger than the number of pixels for which the smallest printing scan order difference is more than the predetermined value. It is preferable that the landing time interval be kept within a predetermined time for each printing target pixel, but the landing time interval may exceed the predetermined time for some printing target pixels.

The smallest printing scan order difference may be calculated for all printing target pixels in which to print a superimposed Me dot, and superimposed Me dots may be printed such that the number of pixels with a lower smallest printing scan order difference is larger in a histogram generated from the smallest printing scan order differences of all printing target pixels. Such a configuration also suppresses deterioration of the above-described coloring reduction effect.

Meanwhile, in the case of forming a superimposed Me dot in temporally adjacent printing scans, the above-mentioned smallest printing scan order difference is "one" (pass). Specifically, the configuration may be such that, in a comparison between the number pixels for which the smallest printing scan order difference is "one" and the number of pixels for which the smallest printing scan order difference is two or more, the number of pixels for which the smallest printing scan order difference is one is larger than the number of pixels for which the smallest printing scan order difference is two or more.

Note that the present embodiment is such that, for a particular printing target pixel of interest, the printing scans for laying two dots on top of each other in that printing target pixel are set to be adjacent to each other in order. That is, in the present embodiment, the order of printing of a particular pixel and a pixel spatially adjacent to it may be any order.

Third Embodiment

In the first and second embodiments, a description has been given of configurations in which the Me ink is superimposed in each printing target pixel to be printed with the Me ink in order to reduce the coloring of the Me ink.

If the Me ink is superimposed in all printing target pixels to be printed with the Me ink, the amount of the Me ink to be used doubles. On the other hand, by the present inventors' study, it was found that the larger the amount of the Me ink printed, the lower its coloring. This is because, as mentioned earlier in the explanation of FIG. 6, as the density of dots in a printing region increases, the brownish outer peripheries of dots are overlapped by other neighboring dots, so that the silver particles at the brownish outer peripheries fuse to silver particles contained in the ink droplets of the other dots or the brownish color is covered by the fused silver film formed by the other dots.

In view of this, in a third embodiment, a description will be given of an example of reducing the amount of the Me ink to be used while achieving the above-described coloring reduction effect. In the present embodiment, the degree of the coloring of the Me ink is estimated based on print data for printing a metallic image. Then, the ratio of the pixels to be printed as superimposed dots among the printing target pixels is controlled based on the estimated degree of the coloring of the Me ink. The present embodiment is directed to a configuration that estimates the degree of the coloring at each printing target pixel based on the density at the printing target pixel, and specifically, reduces the amounts of the Me ink to be used at a high-tone portion.

Print Data Generation Process

Figure 14:
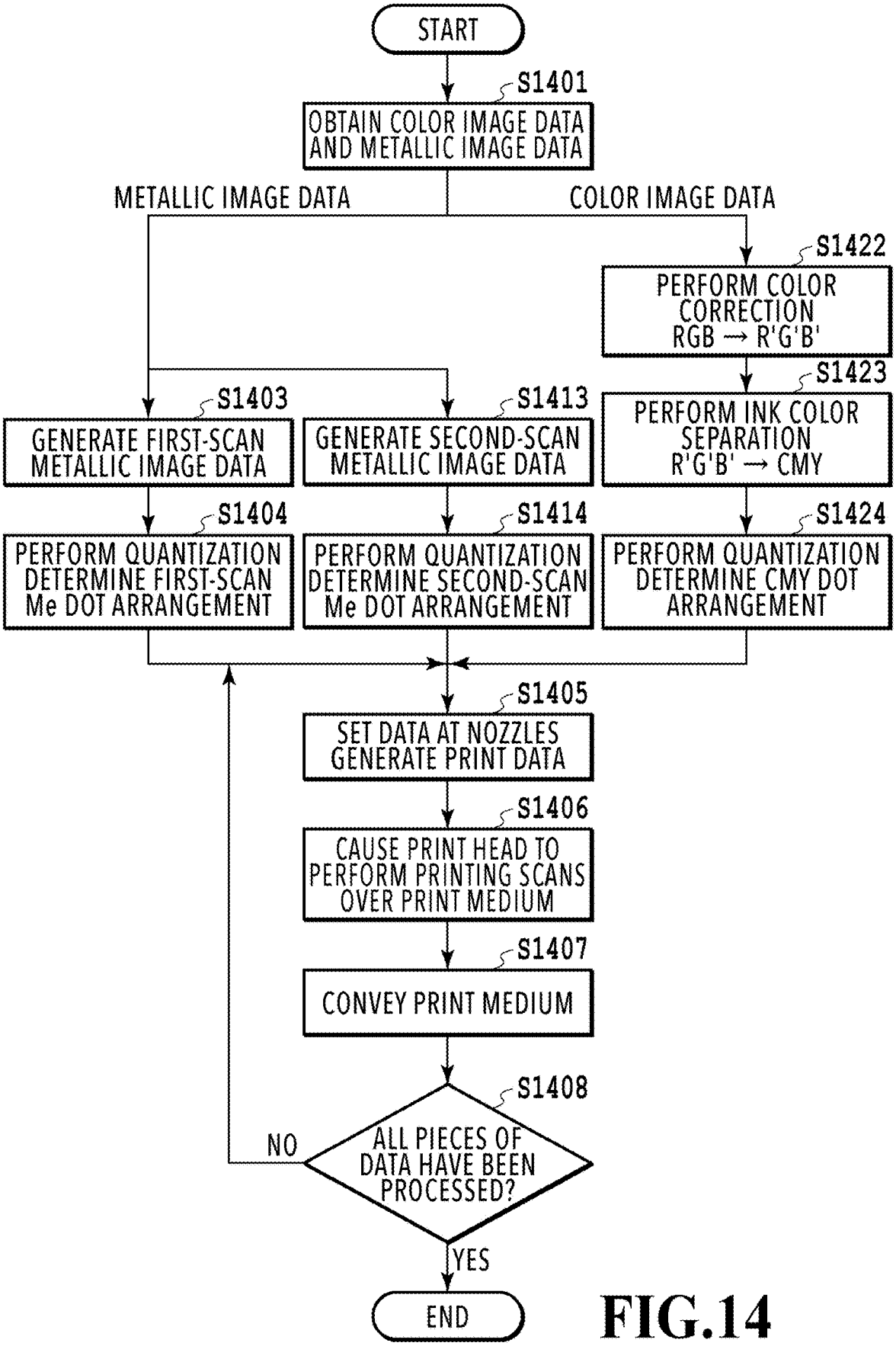
FIG. 14 is a flowchart showing a print data generation process and a printing operation.

FIG. 14 is a diagram explaining a print data generation process executed by the main control unit 11 of the printing apparatus 1 in the third embodiment. S1401 and S1422 to S1424 in FIG. 14 are the same processes as S801 and S822 to S824 in FIG. 8, and description thereof is therefore omitted.

In S1403, the main control unit 11 generates first-scan metallic image data from the metallic image data obtained in S1401. In S1413, the main control unit 11 likewise generates second-scan metallic image data from the metallic image data obtained in S1401. The processes of S1403 and S1413 may be performed in parallel with each other or performed in any order.

Figure 15A:
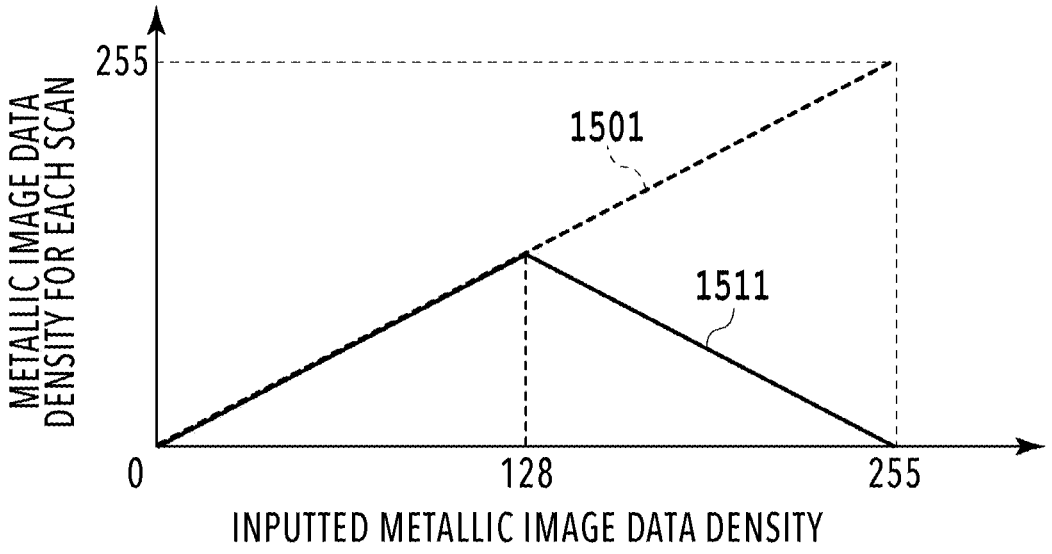
FIGS. 15A and 15B are diagrams explaining an example of generation of pieces of metallic image data.
Figure 15B:
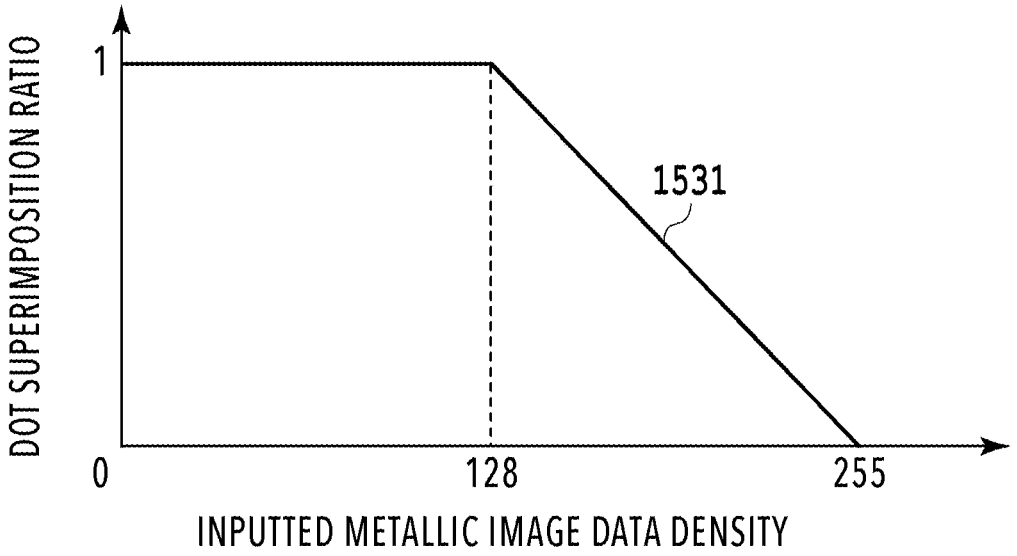

FIGS. 15A and 15B are diagrams explaining an example of the generation of the metallic image data in each of S1403 and S1413. In FIG. 15A, the horizontal axis represents the density of the metallic image data obtained in S1401 while the vertical axis represents the density of the metallic image data to be generated for each scan. In FIG. 15A, a dashed line 1501 represents the first-scan metallic image data to be generated in S1403 while a solid line 1511 represents the second-scan metallic image data to be generated in S1413. In the present embodiment, the first-scan density=the inputted density, and the second-scan density=the inputted density (if the inputted density<128) or 255−the inputted density (if the inputted density≥128).

In this way, the degree of superimposition of the Me ink is highest in a case where the inputted density=128, gradually decreases after the inputted density exceeds 128, and is 0 in a case where the inputted density is 255, which is the maximum density. Here, the degree of superimposition of the Me ink refers to the degree or ratio of Me dot superimposition per predetermined unit area. In an example, in the case where the degree of superimposition (superimposition ratio) is 0, Me dots are formed in a predetermined region only in the first scan. In the case where the degree of superimposition (superimposition ratio) is 1, superimposed Me dots are formed in a predetermined region by printing Me ink dots in the second printing scan with the same density as that of the Me ink dots used in the first printing scan. In the case where the degree of superimposition (superimposition ratio) is 0.5, superimposed Me dots are formed in a predetermined region by printing Me ink dots in the second scan with about a half of the density of the Me ink dots used in the first printing scan.

Meanwhile, in the conversion processes in S1403 and S1413, the pieces of metallic image data may be generated using calculation equations as described above, or tables may be referred to as below.

The first-scan density=one-dimensional table A[inputted density]

The second-scan density=one-dimensional table B[inputted density]

Table 1 shows an example of the one-dimensional tables A and B in the present embodiment. Note that table 1 shows parts of the one-dimensional tables A and B extracted from them.

TABLE 1

| Inputted Metallic Density | First-Scan Density | Second-Scan Density |
|---|---|---|
| 0 | 0 | 0 |
| 1 | 1 | 1 |
| . | . | . |
| . | . | . |
| . | . | . |
| 50 | 50 | 50 |
| . | . | . |
| . | . | . |
| . | . | . |
| 100 | 100 | 100 |
| . | . | . |
| . | . | . |
| . | . | . |
| 120 | 120 | 120 |
| . | . | . |
| . | . | . |
| . | . | . |
| 127 | 127 | 127 |
| 128 | 128 | 127 |
| 129 | 129 | 126 |
| 130 | 130 | 125 |
| . | . | . |
| . | . | . |
| . | . | . |
| 200 | 200 | 55 |
| . | . | . |
| . | . | . |
| . | . | . |

TABLE 1-continued

| Inputted Metallic Density | First-Scan Density | Second-Scan Density |
|---|---|---|
| 254 | 254 | 1 |
| 255 | 255 | 0 |

In S1404, the main control unit 11 quantizes the first-scan metallic image data generated in S1403 and determines a first-scan Me ink dot arrangement. Also, in S1414, the main control unit 11 quantizes the second-scan metallic image data generated in S1413 and determines a second-scan Me ink dot arrangement. In the present embodiment, a dithering method is employed as the method of the quantization in each of S1404 and S1414, and both quantizations use the same dither matrix. This enables the Me ink to be formed and superimposed at the same position on the print medium in the range of inputted density from 1 to 128 in FIG. 15A, in which the dashed line 1501 and the solid line 1511 overlap each other.

FIG. 15B is a diagram showing a relationship between the inputted density and the dot superimposition ratio. In the range of inputted density from 1 to 128, the dot superimposition ratio is 1, so that every dot is a superimposed dot. In the range of inputted density from 128 to 255, on the other hand, it can be seen that the dot superimposition ratio gradually decreases and reaches 0 at an inputted density of 255. In this way, the dot superimposition ratio is decreased from the middle tone according to the phenomenon in which the coloring of the silver nanoink decreases with increase in inputted density.

The processes of S1405 to S1408 are similar processes to S805 to S808 in FIG. 8 in the first embodiment, and description thereof is therefore omitted here. Also, the specific contents of the nozzle positions used within the nozzle arrays, the amount of conveyance, and so on in S1405 to S1407 are similar to those in <Description of Printing Operation> described in the first embodiment, and description thereof is therefore omitted. What is different in the present embodiment is that the pieces of Me dot data allocated to the first scan and the second scan in the dashed line section 906 in FIG. 9 are the pieces of data obtained in S1404 and S1414 and that different pieces of data are allocated.

As described above, the maximum degree of superimposition of the Me ink is set at a level lower than the maximum value of Me ink concentration. This reduces the above-described coloring while suppressing increase in the amount of the Me ink to be used.

Meanwhile, for the method described in the present embodiment so far, an example has been described in which image data is generated for each of the first scan and the second scan from an inputted image and binary quantization is performed on the image data. This example, however, merely shows an example form of the method of controlling the dot superimposition ratio according to the density of the inputted metallic image data.

Figure 16A:
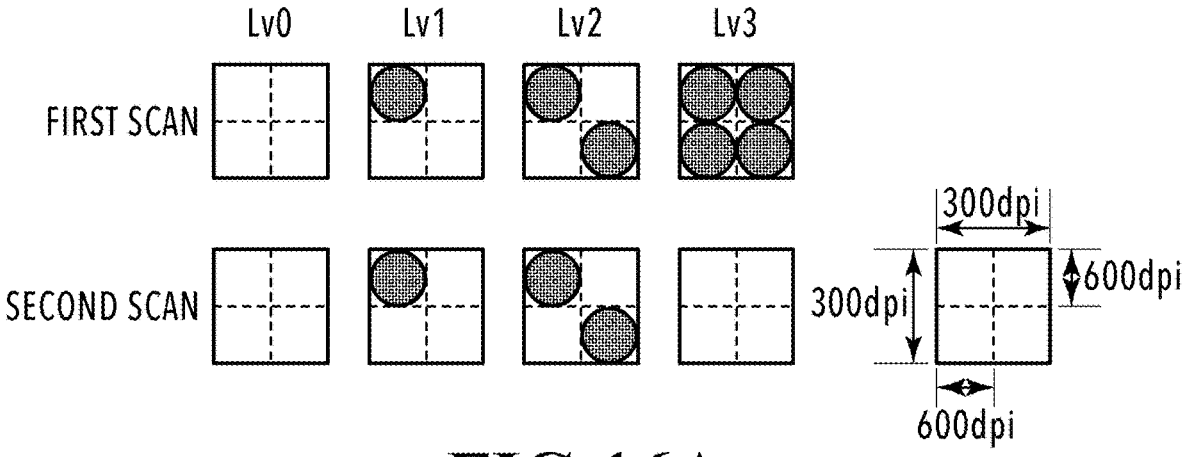
FIGS. 16A to 16C are diagrams explaining another printing method.
Figure 16B:
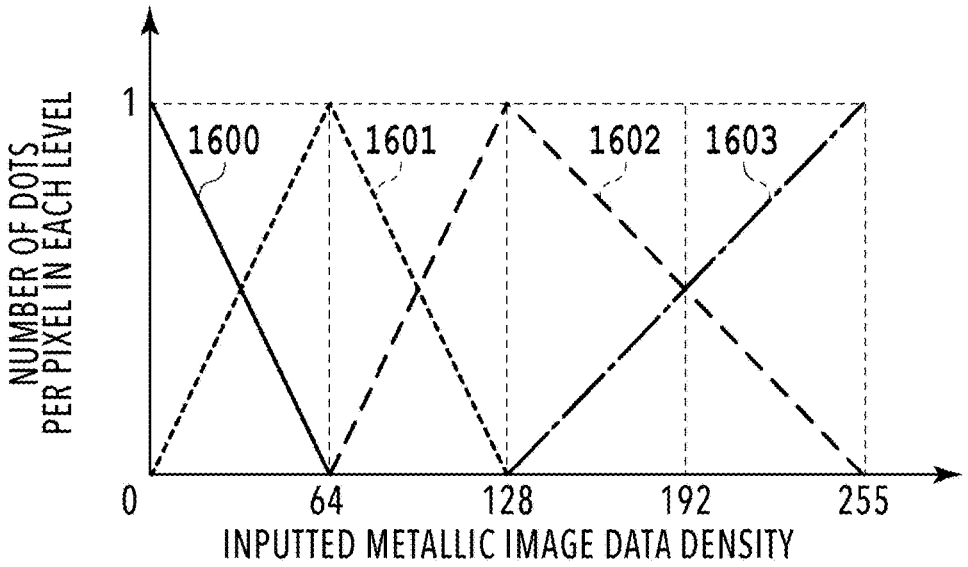
Figure 16C:
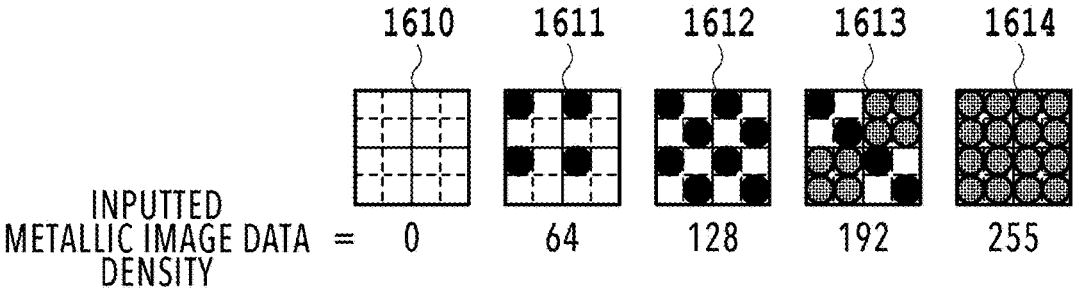

FIGS. 16A to 16C are diagrams showing another printing method that obtains dot superimposition ratios similar to those in the present embodiment. The metallic image obtained in S1401 is quantized using a plurality of values being four levels Lv0 to Lv3, and a set of dot arrangements corresponding to these levels are set for each of the first scan and the second scan. FIG. 16A is a diagram showing specific sets of dot arrangements corresponding to the quantized values for the first scan and the second scan. In FIG. 16A, each solid-line square is at a quantization resolution of 300 dpi, while each of the squares separated by the dashed lines is at a dot arrangement resolution of 600 dpi. A method in which dot arrangements corresponding to quantization levels are set in advance as above is referred to as index expansion.

FIG. 16B shows the ratio of each quantization level on a paper surface versus the inputted metallic image data density. Lines 1600 to 1603 in FIG. 16B correspond to level 0 to level 3, respectively. FIG. 16C shows 2×2 pixel dot arrangements at 300 dpi for predetermined values of inputted metallic image data density. In FIG. 16C, each black dot represents a state where two dots are laid on top of each other, while each shaded dot represents a state with one dot. For example, a dot arrangement 1611 is a dot arrangement for an inputted metallic image data density of 64. FIG. 16B shows that all pixels on the paper surface is at level 1 in a case where the inputted metallic image data density is 64. In other words, the Lv1 dot arrangements for the first scan and the second scan in FIG. 16A are laid on top of each other.

FIGS. 16A to 16C show that every metallic dot generated is a superimposed dot in the range of inputted tone values from 1 to 128 (see the dot arrangements 1610 to 1612). In the range of inputted metallic image data density from 129 to 255, on the other hand, it can be seen that the number of superimposed dots gradually decreases and the dot arrangement shifts toward an arrangement in which dots are adjacent to each other in a matrix. In this manner, dot superimposition ratios similar to those in FIG. 15B are obtained.

As described above, the dot superimposition ratio can be controlled according to the inputted metallic image data density also by using index expansion.

Fourth Embodiment

In the third embodiment, a configuration that estimates the degree of the coloring at a printing target pixel based on the density at the printing target pixel has been described as a configuration that estimates the degree of the coloring of the Me ink based on print data for printing a metallic image. Specifically, a description has been given of a configuration that reduces the amount of the Me ink to be used at a high-tone portion, and a description has been given of an example where this reduction enables reduction of the coloring of the Me ink while suppressing increase in the amount of the Me ink to be used.

Under the assumption that many adjoining printing target pixels are present in a high-density region, the third embodiment uses a coloring reduction effect achieved by overlap of edges of Me dots at these adjoining printing target pixels. Thus, there is a case where the coloring reduction effect is not sufficiently exhibited at the edges of a high-density portion and isolated points therein. In view of this, in a fourth embodiment, a description will be given of an example of suppressing increase in the amount of the Me ink to be used while achieving a color reduction effect also at edges and isolated points in the metallic image. A configuration that estimates the degree of the coloring of the Me ink at a printing target pixel according to the ratio of adjoining pixels around it will be described as a configuration that estimates the degree of the coloring of the Me ink based on print data for printing a metallic image. Specifically, a description will be given of a configuration that estimates the degree of the coloring of the Me ink based on arrangement information on printing target pixels in quantized data of a metallic image, and determines whether to form a superimposed dot.

Print Data Generation Process

Figure 17:
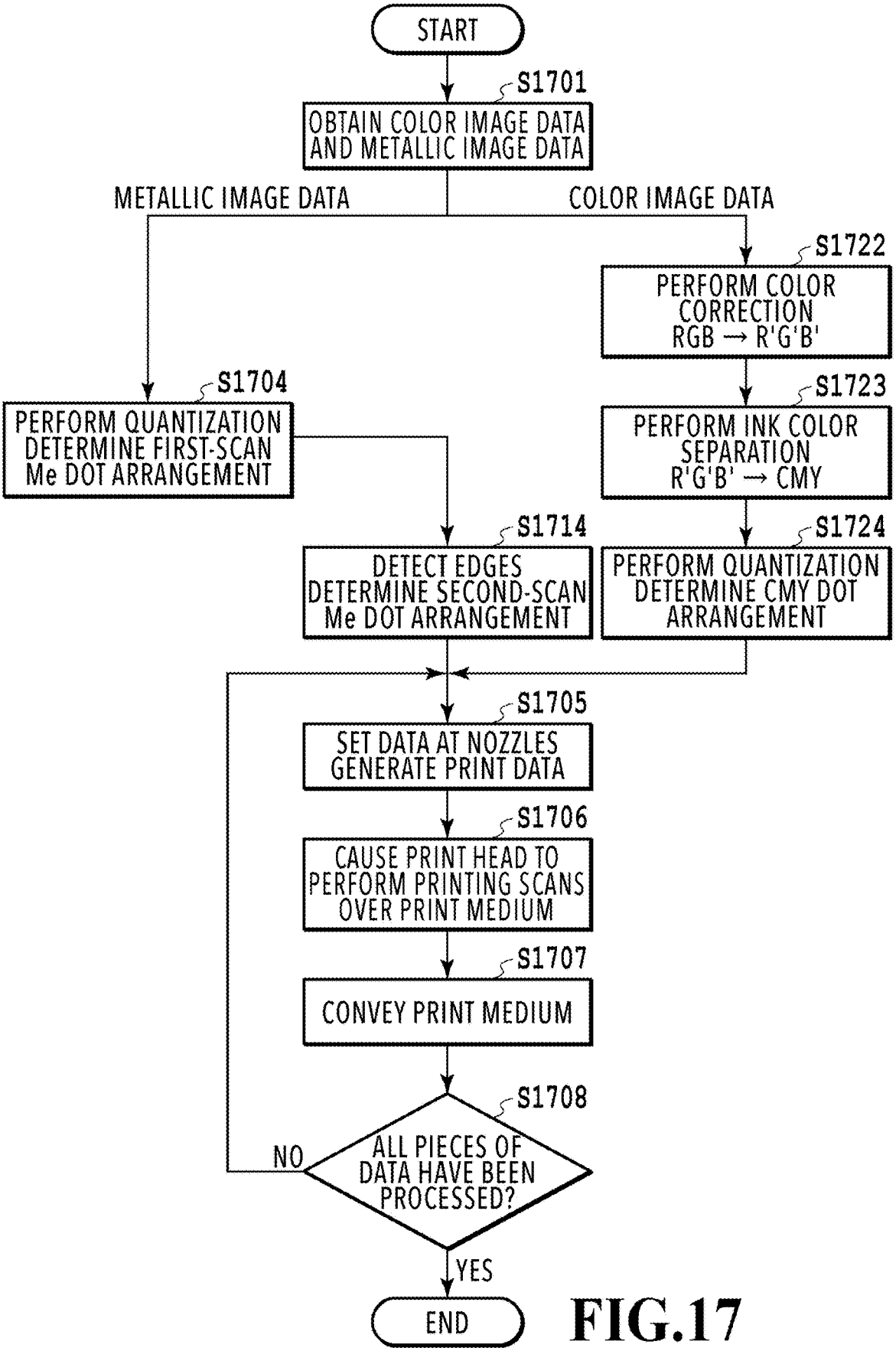
FIG. 17 is a flowchart showing a print data generation process and a printing operation.

FIG. 17 is a flowchart showing a print data generation process in the fourth embodiment. S1701 and S1722 to S1724 in FIG. 17 are the same processes as S801 and S822 to S824 in FIG. 8, and description thereof is therefore omitted.

In S1704, the main control unit 11 quantizes the metallic image data obtained in S1701 and determines a first-scan Me ink dot arrangement.

In S1714, the main control unit 11 determines a second-scan Me ink dot arrangement based on the first-scan Me ink dot arrangement generated in S1704.

Figure 18:
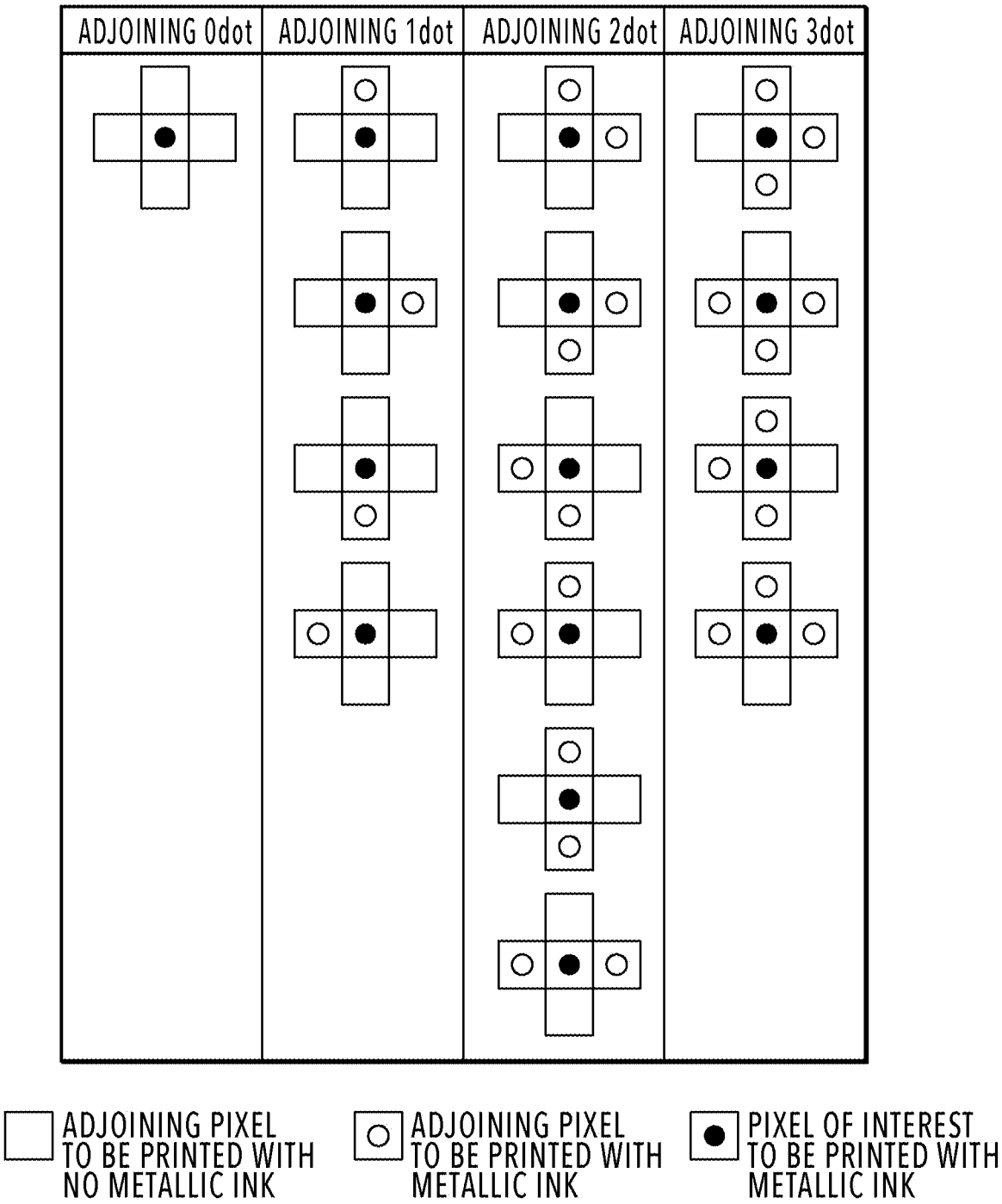
FIG. 18 is a diagram explaining determination of a second-scan dot arrangement.

FIG. 18 is a diagram explaining the determination of the second-scan Me ink dot arrangement based on the first-scan Me ink dot arrangement in S1714. In the present embodiment, every single pixel is a pixel of interest, and pixel-by-pixel processing is performed. In a case where a first-scan dot of the Me ink is present in the pixel of interest as shown in FIG. 18, the number of pixels among the upper, lower, left, and right adjoining pixels in which a first-scan dot of the Me ink is present is determined. In the present embodiment, the Me ink will be superimposed in a case where there is even one pixel in which the Me ink is not to be printed among the upper, lower, left, and right pixels. Thus, a second-scan dot will be formed in a case where a first-scan dot of the Me ink is present in none to three of the upper, lower, left, and right adjoining pixels around the pixel of interest. In other words, no second-scan dot will be formed (a superimposed dot will not be formed) in a case where a first-scan dot of the Me ink is present in all of the upper, lower, left, and right adjoining pixels around the pixel of interest.

Figure 19:
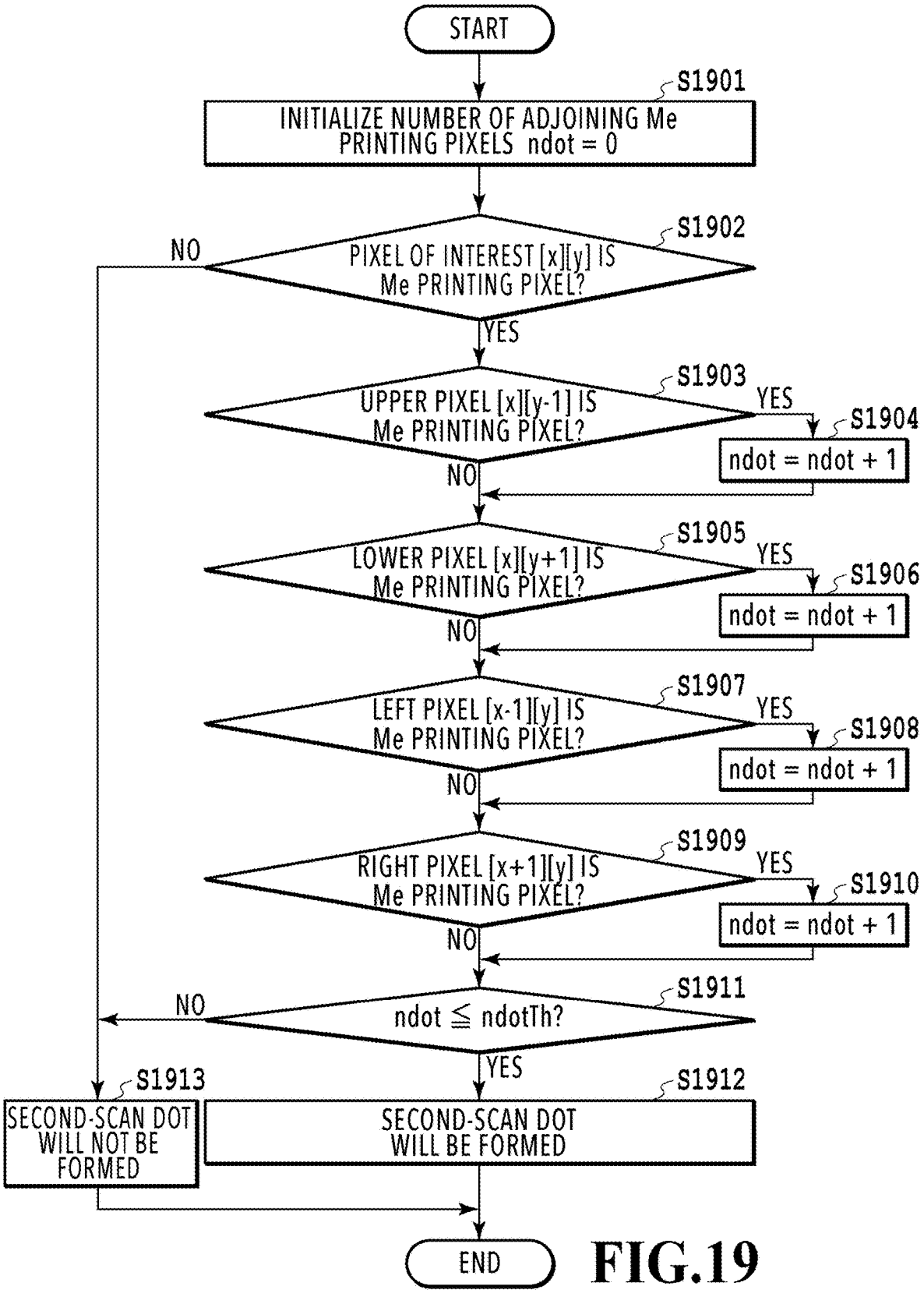
FIG. 19 is a flowchart explaining the determination of the second-scan dot arrangement.

FIG. 19 shows a detailed flowchart of S1714 for each pixel. The processes in FIG. 19 are processes for a single pixel of interest, and processing is performed in which the processes in FIG. 19 target every single pixel as a pixel of interest.

In S1901, the main control unit 11 initializes a number ndot of adjoining Me printing target pixels as below.

ndot=0

In S1902, the main control unit 11 determines whether a first-scan dot of the Me ink is present in a pixel of interest [x][y]. The main control unit 11 proceeds to S1913 if the result of the determination is no. The main control unit 11 proceeds to S1903 if the result of the determination is yes.

In S1903, the main control unit 11 determines whether a first-scan dot of the Me ink is present in an upper adjoining pixel [x][y−1]. The main control unit 11 proceeds to S1905 if the result of the determination is no. If the result of the determination is yes, the main control unit 11 proceeds to S1904, in which it increments the number of adjoining Me printing pixels by one and then proceeds to S1905.

In S1905, the main control unit 11 determines whether a first-scan dot of the Me ink is present in a lower adjoining pixel [x][y+1]. The main control unit 11 proceeds to S1907 if the result of the determination is no. If the result of the determination is yes, the main control unit 11 proceeds to S1906, in which it increments the number of adjoining Me printing pixels by one and then proceeds to S1907.

In S1907, the main control unit 11 determines whether a first-scan dot of the Me ink is present in a left adjoining pixel [x−1][y]. The main control unit 11 proceeds to S1909 if the result of the determination is no. If the result of the determination is yes, the main control unit 11 proceeds to S1908, in which it increments the number of adjoining Me printing pixels by one and then proceeds to S1909.

In S1909, the main control unit 11 determines whether a first-scan dot of the Me ink is present in a right adjoining pixel [x+1][y]. The main control unit 11 proceeds to S1911 if the result of the determination is no. If the result of the determination is yes, the main control unit 11 proceeds to S1910, in which it increments the number of adjoining Me printing pixels by one and then proceeds to S1911.

In S1911, the main control unit 11 determines whether or not the number of adjoining Me printing pixels is a predetermined threshold value or less. In the present embodiment, the predetermined threshold value is ndotTh=3. The main control unit 11 proceeds to S1913 if the result of the determination is no. The main control unit 11 proceeds to S1912 if the result of the determination is yes.

In S1912, the main control unit 11 performs control such that a second-scan dot of the Me ink will be formed in the pixel of interest [x][y]. Specifically, the main control unit 11 sets 1 for the pixel of interest [x][y], and terminates the processing for the pixel.

In S1913, the main control unit 11 performs control such that a second-scan dot of the Me ink will not be formed in the pixel of interest [x][y]. Specifically, the main control unit 11 sets 0 for the pixel of interest [x][y], and terminates the processing for the pixel. The processing described above is the process of S1714 in FIG. 17.

In S1705, the main control unit 11 generates print data for a single scan from the dot data of each ink generated in S1704, S1714, and S1724. Then, the main control unit 11 sets the dot data in predetermined regions in the C (cyan), M (magenta), Y (yellow), and Me (metallic) nozzle arrays. Subsequent S1706 to S1708 are similar to S806 to S808 in the first embodiment. Also, the specific contents of the nozzle positions used within the nozzle arrays, the amount of conveyance, and so on are similar to those in <Description of Printing Operation> described in the first embodiment. What is different in the present embodiment is that the pieces of Me dot data allocated to the first scan and the second scan in the dashed line section 906 are those obtained in S1704 and S1714 and that different pieces of data are allocated.

As described above, in the present embodiment, edge and isolated pixels are detected and the Me ink is superimposed in these pixels. This enables accurate reduction of the above-described coloring while suppressing increase in the amount of the Me ink to be used.

Note that while whether to superimpose a dot is determined in the present embodiment by referring the number of Me dots in the four pixels on the upper, lower, left, and right sides, whether to superimpose a dot may be determined based on the number of Me dots in the eight pixels on the upper, lower, left, and right sides and the diagonal corners. Further, the number of Me dots in the adjoining pixels as the threshold value with which to determine whether to superimpose a dot is not limited to the value in the present embodiment. For example, in a case where the degree of the coloring is low, the threshold value ndotTh=3 in the present embodiment may be reduced to 2. This reduces the ratio of superimposed dots and therefore reduces the amount of the ink to be used.

The above-described embodiment can also be described as below. Assume, for example, a case where Me ink printing target pixels include a first-type printing target pixel and a second-type printing target pixel. The first-type printing target pixel is a pixel having a smaller number of Me ink printing target pixels among adjoining pixels adjoining the first-type printing target pixel than the second-type printing target pixel does. In this case, the value of the result of coloring degree estimation on the first-type printing target pixel (a higher value indicates a higher degree of the coloring) is higher than the value of the result of coloring degree estimation on the second-type printing target pixel. In other words, the larger the number of Me ink printing target pixels among adjoining pixels, the greater the degree of the coloring is estimated to be reduced by the overlap between the edges of the Me dots in the adjoining printing target pixels.

Fifth Embodiment

The foregoing embodiments have been described without particularly mentioning a difference by the type of print medium. Note that the degree of the coloring of the Me ink can vary by the type of print medium. In the present embodiment, a description will be given of an example where the degree of superimposition of the Me ink is switched according to the type of print medium. Specifically, a description will be given of a configuration in which a plurality of printing modes is settable which differ from each other in the ratio of the pixels to be printed as superimposed dots among the Me ink printing target pixels.

Referring to FIG. 6 again, the comparison between mat paper and glossy paper shows that the degree of the coloring is higher with the mat paper than with the glossy paper.

Figure 20A:
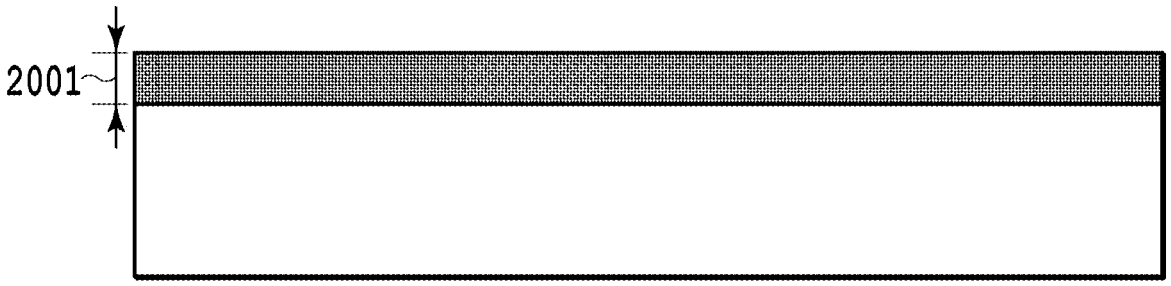
FIGS. 20A and 20B are diagrams explaining that the degree of the coloring varies by the print medium.
Figure 20B:
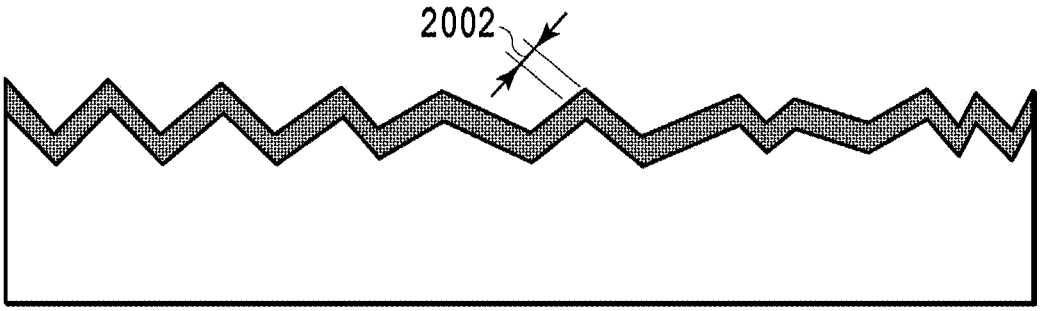

The degree of the coloring varies due to various reasons. For example, a difference in the surface roughness of the print medium causes a difference in the degree of the coloring. The reason for this will be described with reference to FIGS. 20A and 20B. FIG. 20A is a schematic diagram showing a state where a liquid has wetted and spread over a smooth surface. FIG. 20B is a schematic diagram showing a state where the liquid of the same amount as FIG. 20A has wetted and spread over a surface with concavities and convexities. In a comparison between liquid heights 2001 and 2002, the liquid with the height 2002 on the surface with concavities and convexities has a larger surface area and therefore has a smaller thickness on the surface per unit area. In other words, the density of silver particles per unit area is lower and therefore the efficiency of fusion between silver particles is lower on the surface with concavities and convexities than on the smooth surface.

Figure 21A:
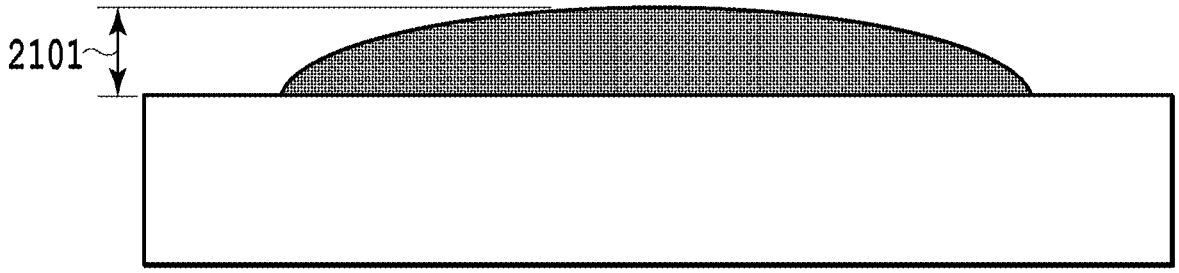
FIGS. 21A and 21B are diagrams explaining that the degree of the coloring varies by the print medium.
Figure 21B:
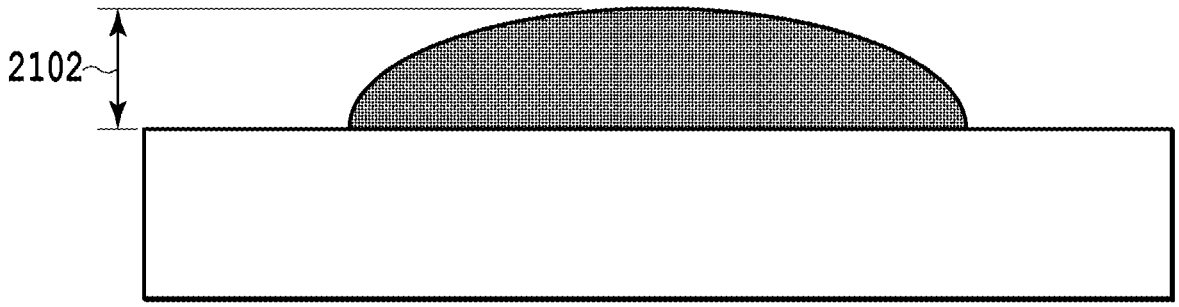

A difference in the surface free energy (surface tension) of the print medium also causes a difference in the degree of the coloring. The reason for this will be described with reference to FIGS. 21A and 21B. FIG. 21A and FIG. 21B are schematic diagrams showing the spread and heights of ink droplets on print medium surfaces differing in surface free energy. FIG. 21A shows a state where the ink spreads more easily since the print medium surface has higher surface tension, while FIG. 21B shows a state where the ink spreads less easily since the print medium surface has lower surface tension. In a case where ink droplets of a same amount land on the print media in FIGS. 21A and 21B, an ink height 2101 on the surface with higher surface tension is lower than an ink height 2102 on the surface with lower surface tension. In FIG. 21A, in which the dot spreads wider than that in FIG. 21B, as the aqueous medium in the ink droplet permeates the print medium, the density of silver particles per unit area in the dot decreases, so that the efficiency of fusion between silver particles decreases.

Figure 22A:
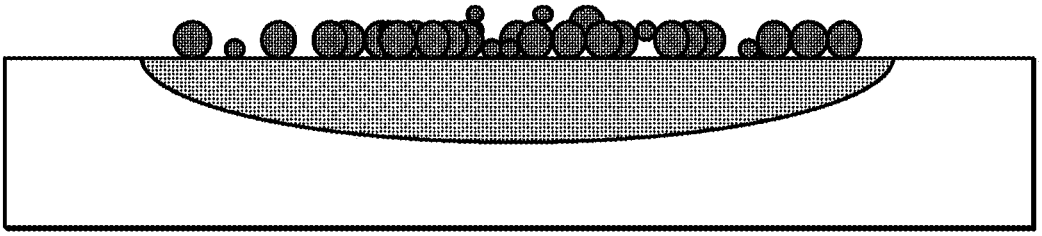
FIGS. 22A and 22B are diagrams explaining that the degree of the coloring varies by the print medium.
Figure 22B:
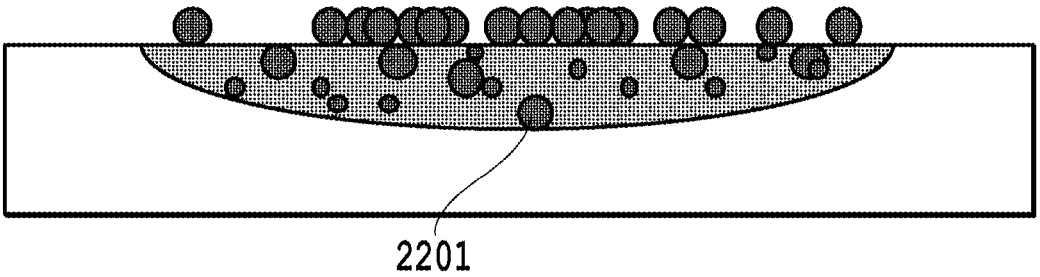

Moreover, a difference in the absolute value or distribution of the particle size of inorganic particles contained in the receiving layer of the print medium also causes a difference in the degree of the coloring. The reason for this will be described with reference to FIGS. 22A and 22B. FIGS. 22A and 22B are schematic diagrams showing the behaviors of silver particles in cases differing in the size of the inorganic particles in the receiving layer. FIG. 22B shows a state 2201 where the size of pores formed by the inorganic particles is larger than that in FIG. 22A, so that some silver particles have permeated the print medium. Since the outsides of the silver particles in the print medium are surrounded by the inorganic particles, their silver fusion hardly occurs. In other words, in the case where the size of the pores formed by the inorganic particle is large as in FIG. 22B, the absolute number of silver particles on the print medium surface is smaller than that in FIG. 22A, and therefore the efficiency of fusion between silver particles is lower.

As described above, with different print media, the degree of the coloring of the Me ink varies due to various factors. Also, in the case of reducing the coloring by laying two dots on top of each other as in the foregoing embodiments, the dot power per dot is strong. This may increase the graininess. In view of these, in the present embodiment, a description will be given of the fact that the increase in graininess can be minimized by switching the printing process, i.e., the degree of superimposition using two dots, according to the degree of the coloring with the print medium.

Figure 23:
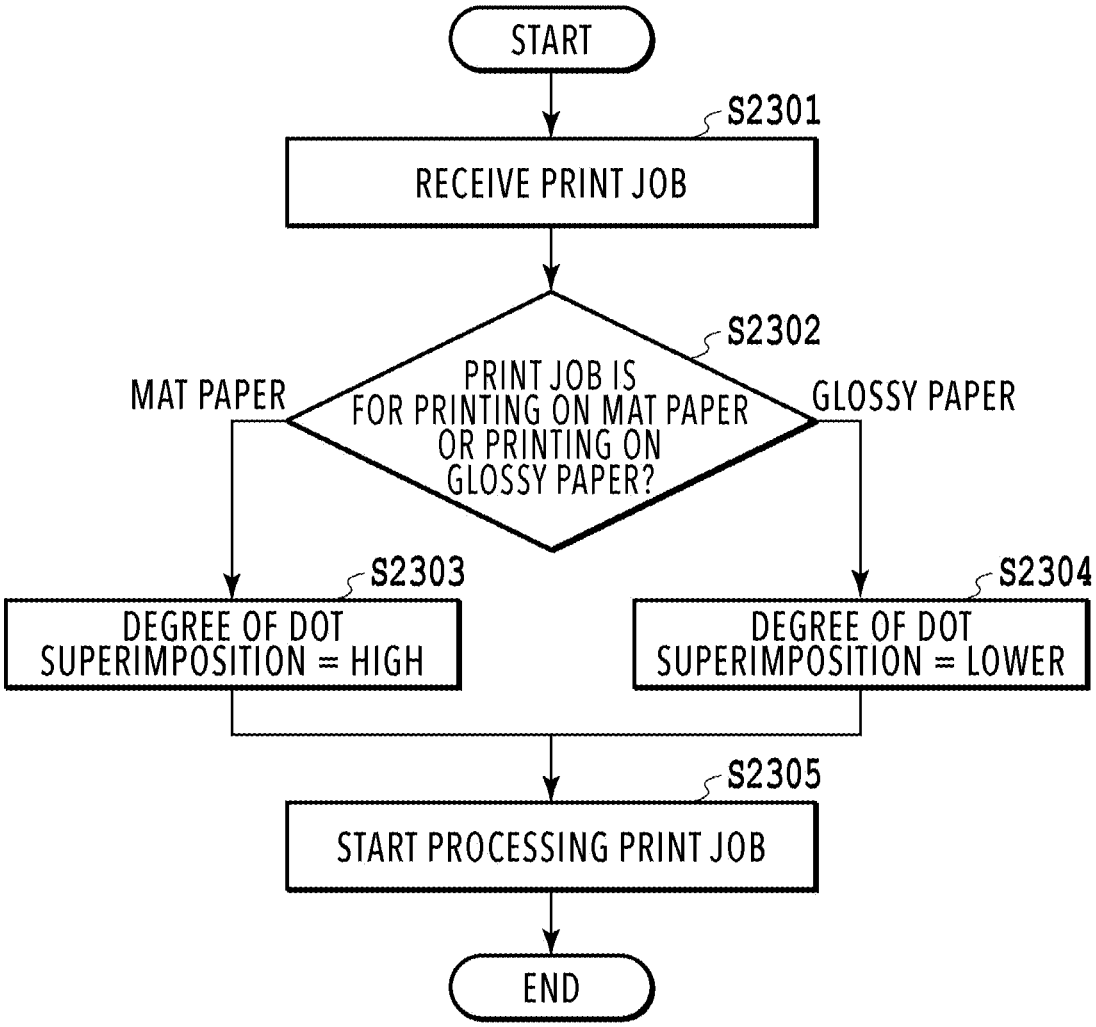
FIG. 23 is a flowchart showing a print data generation process and a printing operation.

A method of switching the printing process to be executed by the main control unit 11 of the printing apparatus 1 in the present embodiment will be described below with reference to FIG. 23. The CPU installed in the main control unit 11 of the printing apparatus 1 deploys a program stored in the ROM into the RAM and executes the deployed program. As a result, each process in FIG. 23 is executed.

In S2301, the main control unit 11 receives a print job supplied from the image processing apparatus 2.

In S2302, the main control unit 11 determines whether the print medium for the job received in S2301 is mat paper or glossy paper. The determination is made by referring to paper setting information set by the user who generated the print job or paper setting information held in the print data buffer 12. The main control unit 11 proceeds to S2303 if the result of the determination indicates mat paper, and proceeds to S2304 if the result of the determination indicates glossy paper.

In S2302, mat paper is taken as an example of a print medium with which the degree of the color is high, and glossy paper is taken as an example of a print medium with which the degree of the coloring is low. Note, however, that the classifications and types of print media for switching the printing process are not limited to these. In an example, the printing process may be switched by different types of glossy paper. Also, in the present embodiment, the determination is based on two types of paper, mat paper and glossy paper. However, the printing process may be switched based on three or more types of paper in a case where each of them differs from the others in the degree of the coloring and requires switching of the printing process.

If the paper setting information in the print job indicates mat paper, then in S2303, the main control unit 11 configures a setting for performing a printing process with a high degree of dot superimposition. On the other hand, if the paper setting information in the print job indicates glossy paper, then in S2304, the main control unit 11 configures a setting for performing a printing process with a low degree of dot superimposition.

Then in S2305, the main control unit 11 executes a printing process differently according to the setting for the printing process with a high degree of dot superimposition or the setting for the printing process with a low degree of dot superimposition. Specifically, the printing process described in FIG. 14 is performed.

Figure 24A:
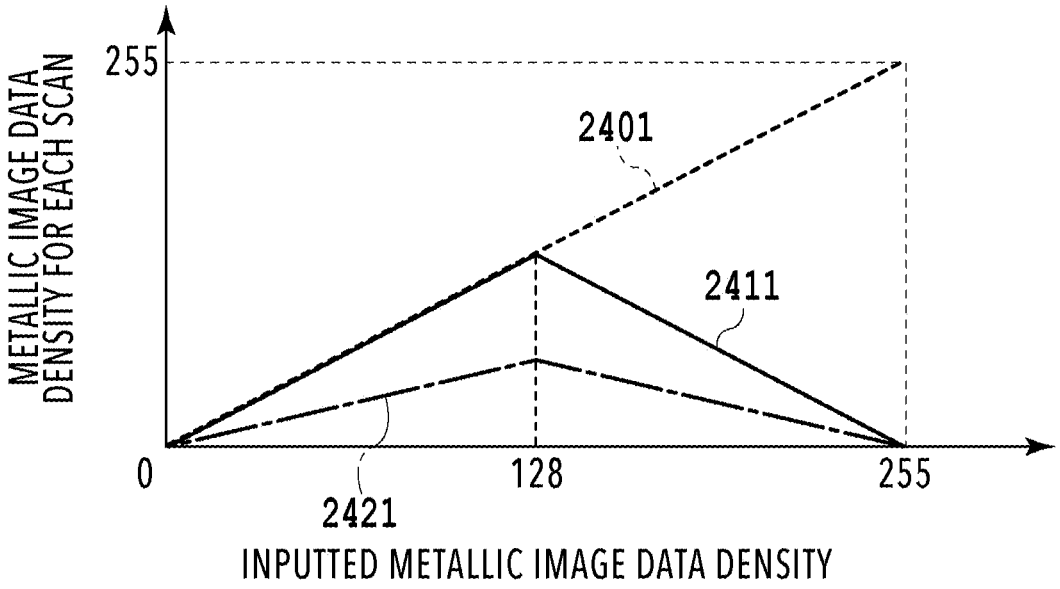
FIGS. 24A and 24B are diagrams explaining printing processes differing in the degree of dot superimposition.
Figure 24B:
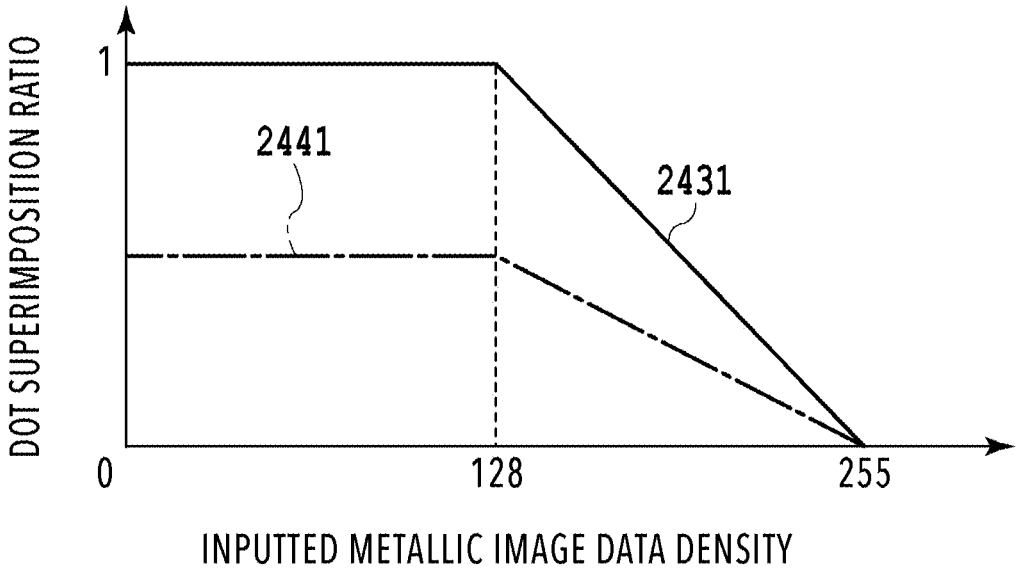

FIGS. 24A and 24B are diagrams explaining an example of the difference between the printing process with a high degree of dot superimposition and the printing process with a low degree of dot superimposition. In FIG. 24A, like FIG. 15A, the horizontal axis represents the density of the metallic image data obtained in S1401 while the vertical axis represents the density of the metallic image data to be generated for each scan. A dashed line 2401 in FIG. 24A represents the first-scan metallic image data to be generated in S1403 which are shared by the printing process with a high degree of dot superimposition and the printing process with a low degree of dot superimposition. A solid line 2411 in FIG. 24A represents second-scan metallic image data for the printing process with a high degree of dot superimposition. Also, a long dashed short dashed line 2421 in FIG. 24A represents second-scan metallic image data for the printing process with a low degree of dot superimposition.

In this manner, in the range of inputted density from 1 to 128, all Me dots are controlled to be superimposed dots in the printing process with a high degree of dot superimposition. On the other hand, in the printing process with a low degree of dot superimposition, approximately a half of the Me dots printed in the first printing scan are controlled to be superimposed dots.

FIG. 24B shows the difference in dot superimposition ratio. A solid line 2431 in FIG. 24B shows the dot superimposition ratio in the printing process with a high degree of dot superimposition. A long dashed short dashed line 2441 in FIG. 24B shows the dot superimposition ratio in the printing process with a low degree of dot superimposition. By switching the degree of dot superimposition as described above, the dot superimposition ratio is varied according to the degree of the coloring with the print medium.

In the present embodiment, the number of superimposed dots is largest at an inputted density of 128 for both the printing process with a high degree of dot superimposition and the printing process with a low degree of dot superimposition. Note, however, that the inputted tone value at which the number of superimposed dots is largest may be varied between the printing processes. Also, in the process with a low degree of dot superimposition, no dot may be superimposed. Specifically, the image data density along the long dashed short dashed line 2421 in FIG. 24A may be set at 0 for all inputs.

Also, at least one of the number of pixels handled as the adjoining pixels described in the fourth embodiment (the four upper, lower, left, and right pixels or the eight pixels additionally including those at the diagonal corners) and the threshold value ndotTh may be switched according to the dot superimposition ratio.

Also, the restriction on the printing scan direction may be varied between the printing process with a high degree of dot superimposition and the printing process with a low degree of dot superimposition. Using the same printing scan direction for dots to be laid on top of each other has a coloring reduction effect, as mentioned earlier. Specifically, unidirectional printing, which uses a single printing direction, may be performed for a print medium with which the degree of the coloring is high, while bidirectional printing may be performed for a print medium with which the degree of the coloring is low. This improves the productivity with a print medium with which the degree of the coloring is low.

Other Embodiments

While the main control unit 11 of the printing apparatus 1 executes the processes in the description of the foregoing embodiments, the present invention is not limited to this configuration. Specifically, the main control unit 21 of the image processing apparatus 2 may execute all or some of the processes described in the embodiments.

Also, a description has been given by taking as an example a configuration in which inks of three chromatic colors of cyan (C), magenta (M), and yellow (Y) are used as the chromatic color inks. However, the number of chromatic color inks to be used may less than three or more than three.

Also, a description has been given by taking as an example a configuration in which the print head moves on the print medium and performs printing on the print medium. However, an image may be printed by ejecting ink from the ejection openings while moving the print medium in a direction crossing the direction of the ejection openings arrangement using a print head in which the ejection openings are arranged over the length of the width of the print medium.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-077273, filed Apr. 15, 2019, which is hereby incorporated by reference herein in its entirety.

What is claimed is:

1. An inkjet printing apparatus comprising:

a print head configured to eject a metallic ink containing silver particles;

a carriage configured to scan the print head; and a control unit configured to obtain metallic image data indicating tones in a metallic image and to control a print operation so as to print the metallic image on a print medium by causing the print head to eject the metallic ink onto the print medium and thereby form dots on the print medium while causing the carriage to scan the print head a plurality of times over a predetermined region on the print medium, wherein the control unit controls the print operation so as to print the metallic image by causing the print head to eject the metallic ink at the same pixel position on the print medium in two or more printing scans and thereby generate a superimposed dot, and wherein the control unit causes the print head, (1) in a first scan over the predetermined region, to eject a metallic ink on the predetermined region based on the metallic image data, and (2) in a second scan over the predetermined region after the first scan, (a) in a case where the density of the metallic image is a predetermined density, to eject a metallic ink on the predetermined region in a first image density, and (b) in a case where the density of the metallic image is greater than the predetermined density, to eject a metallic ink on the predetermined region in a second image density smaller than the first image density.

2. The inkjet printing apparatus according to claim 1, wherein the two or more printing scans for forming the superimposed dot are printing scans performed by scanning the print head in a same scan direction.

3. The inkjet printing apparatus according to claim 1, wherein an image in a predetermined region is printed in N (N≥3) or more printing scans over the predetermined region, and wherein the superimposed dot is formed by causing the print head to eject the metallic ink at a same pixel position in each of temporally adjacent printing scans.

4. The inkjet printing apparatus according to claim 1, wherein an image in a predetermined region is printed in N (N≥3) or more printing scans over the predetermined region, and wherein the superimposed dot is formed by causing the print head to eject the metallic ink in printing scans having a printing scan order difference therebetween within a predetermined range.

5. The inkjet printing apparatus according to claim 1, wherein every dot printed with the metallic ink is the superimposed dot.

6. The inkjet printing apparatus according to claim 1, wherein a ratio of pixels to be printed as the superimposed dots among printing target pixels to be printed with the metallic ink is controlled based on a degree of coloring of the metallic ink estimated based on print data for printing the metallic image.

7. The inkjet printing apparatus according to claim 6, wherein the ratio of the pixels to be printed as the superimposed dots among the printing target pixels to be printed with the metallic ink is increased as the estimated degree of the coloring of the metallic ink increases.

8. The inkjet printing apparatus according to claim 6, wherein the degree of the coloring of the metallic ink is estimated from an inputted tone value of the metallic image.

9. The inkjet printing apparatus according to claim 8, wherein an inputted tone value with which the degree of the coloring of the metallic ink is highest represents a lower tone than a highest inputted tone value of the metallic image.

10. The inkjet printing apparatus according to claim 6, wherein the degree of the coloring of the metallic ink is estimated based on arrangement information on printing target pixels in the print data of the metallic image.

11. The inkjet printing apparatus according to claim 10, wherein the arrangement information on the printing target pixels is information specifying an ink ejection volume per predetermined unit area.

12. The inkjet printing apparatus according to claim 10, wherein the printing target pixels to be printed with the metallic ink include a first-type printing target pixel and a second-type printing target pixel having a larger number of printing target pixels to be printed with the metallic ink among adjoining pixels adjoining the second-type printing target pixel than the first-type printing target pixel does, and wherein a result of estimation of the degree of the coloring at the first-type pixel is higher than a result of estimation of the degree of the coloring at the second-type pixel.

13. The inkjet printing apparatus according to claim 10, wherein the superimposed dot is formed in a predetermined printing target pixel to be printed with the metallic ink in a case where the number of printing target pixels to be printed with the metallic ink among adjoining pixels adjoining upper, lower, left, and right sides of the predetermined printing target pixel is a predetermined threshold value or less.

14. The inkjet printing apparatus according to claim 6, wherein a plurality of printing modes are settable which differ from each other in the ratio of the pixels to be printed as the superimposed dots among the printing target pixels to be printed with the metallic ink, and wherein the plurality of printing modes are switchable according to a type of a print medium to be printed with the metallic ink.

15. The inkjet printing apparatus according to claim 14, wherein a first printing mode is set in a case of using such a print medium that density of silver particles in a single metallic dot formed on a surface of the print medium by ejecting the metallic ink onto the print medium is a first density, and wherein a second printing mode lower in the ratio than the first printing mode is set in a case of using such a print medium that density of silver particles in a single metallic dot formed on a surface of the print medium is a second density higher than the first density.

16. The inkjet printing apparatus according to claim 1, wherein the print head is further capable of ejecting a chromatic color ink, and wherein the chromatic color ink is ejected at a predetermined pixel position after a predetermined time interval following ejection of the metallic ink at the predetermined position.

17. The inkjet printing apparatus according to claim 1, wherein the predetermined density is half of a value of maximum density of the metallic image.

18. The inkjet printing apparatus according to claim 1, wherein the control unit causes the print head, in the second scan over the predetermined region, in a case where the density of the metallic image is a third density smaller than a second density which is equal to or smaller than the predetermined density, to eject a metallic ink on the predetermined region in a lower density than in a case of the density of the metallic image being the second density.

19. An inkjet printing apparatus comprising:

a print head configured to eject a metallic ink containing silver particles;

a carriage configured to scan the print head; and a control unit configured to control a print operation so as to print an image on a print medium by causing the print head to eject the metallic ink onto the print medium and thereby form dots on the print medium while causing the carriage to scan the print head a plurality of times over a predetermined region on the print medium, wherein the control unit controls the print operation so as to print the image by causing the print head to eject the metallic ink at the same pixel position on the print medium in two or more printing scans and thereby generate a superimposed dot, wherein an image in a predetermined region is printed in N (N≥3) or more printing scans over the predetermined region, and wherein the number of printing target pixels for which a smallest printing scan order difference between any two printing scans for forming the superimposed dot is a predetermined value or less is larger than the number of printing target pixels for which the smallest printing scan order difference is more than the predetermined value.

20. The inkjet printing apparatus according to claim 19, wherein in a comparison between the number of printing target pixels for which the smallest printing scan order difference is 1 and the number of printing target pixels for which the smallest printing scan order difference is 2 or more, the number of printing target pixels for which the smallest printing scan order difference is 1 is larger than the number of printing target pixels for which the smallest printing scan order difference is 2 or more.

21. A printing method comprising:

obtaining metallic image data indicating tones in a metallic image; and printing the metallic image on a print medium by ejecting a metallic ink containing silver particles onto the print medium from a print head configured to eject the metallic ink while moving relatively the print head and the print medium, a plurality of times over a predetermined region on the print medium, wherein in the printing, the metallic image is formed to include a superimposed dot formed by causing the print head to eject the metallic ink at the same pixel position in two or more printing scans, and wherein the printing includes: (1) in a first scan over the predetermined region, ejecting a metallic ink on the predetermined region based on the metallic image data; and (2) in a second scan over the predetermined region after the first scan, (a) in a case where the density of the metallic image is a predetermined density, ejecting a metallic ink on the predetermined region in a first image density, and (b) in a case where the density of the metallic image is greater than the predetermined density, ejecting a metallic ink on the predetermined region in a second image density smaller than the first image density.

22. A non-transitory computer-readable storage medium storing a program which causes a computer to perform a printing method, the method comprising:

obtaining metallic image data indicating tones in a metallic image; and printing the metallic image on the print medium by ejecting a metallic ink containing silver particles onto the print medium from a print head configured to eject the metallic ink while moving relatively the print head and the print medium a plurality of times over a predetermined region on the print medium, wherein in the printing, the metallic image is formed to include a superimposed dot formed by causing the print head to eject the metallic ink at a same pixel position in two or more printing scans, and wherein the printing includes: (1) in a first scan over the predetermined region, ejecting a metallic ink on the predetermined region based on the metallic image data; and (2) in a second scan over the predetermined region after the first scan, (a) in a case where the density of the metallic image is a predetermined density, ejecting a metallic ink on the predetermined region in a first image density, and (b) in a case where the density of the metallic image is greater than the predetermined density, ejecting a metallic ink on the predetermined region in a second image density smaller than the first image density.

* * * * *